US011141876B2

(12) United States Patent
Janowski

(10) Patent No.: US 11,141,876 B2
(45) Date of Patent: Oct. 12, 2021

(54) VEHICLE SUPPORTED WOOD SPLITTER AND METHODS OF USE

(71) Applicant: Brian Patrick Janowski, Marquette, MI (US)

(72) Inventor: Brian Patrick Janowski, Marquette, MI (US)

( * ) Notice: Subject to any disclaimer, the term of this patent is extended or adjusted under 35 U.S.C. 154(b) by 338 days.

(21) Appl. No.: 16/049,710

(22) Filed: Jul. 30, 2018

(65) Prior Publication Data

US 2019/0030749 A1 Jan. 31, 2019

Related U.S. Application Data

(60) Provisional application No. 62/538,694, filed on Jul. 29, 2017.

(51) Int. Cl.
*B27L 7/06* (2006.01)

(52) U.S. Cl.
CPC ..... *B27L 7/06* (2013.01)

(58) Field of Classification Search
CPC ... B27L 7/06; B27L 7/00; B27L 7/005; B60R 9/06
USPC ..... 144/366; 30/308.1–308.3, 379, 379.5; 224/520
See application file for complete search history.

(56) References Cited

U.S. PATENT DOCUMENTS 1,830,769 A 11/1931 Edgar
2,203,632 A 6/1940 Munson et al.
2,646,955 A 7/1953 Russell
2,851,072 A 9/1958 Gerjets et al.
3,026,865 A 3/1962 Kazuichi
3,100,481 A 8/1963 Stefanick
3,242,955 A 3/1966 Hellstrom
3,802,473 A 4/1974 Carr
3,886,927 A 6/1975 Chattin
3,924,501 A 12/1975 Cohen et al.
4,239,198 A 12/1980 Trupp
4,244,407 A 1/1981 McMullin
4,315,534 A 2/1982 Blackstone
4,341,246 A 7/1982 Salladay
4,362,194 A 12/1982 Lawson
4,378,037 A 3/1983 Conn
4,411,298 A 10/1983 Ellingsen et al.
(Continued)

OTHER PUBLICATIONS

Kindling Cracker King. From internet.
Mr. Quicksplit. Internet sourced.

*Primary Examiner* — Shelley M Self
*Assistant Examiner* — Teresa A Guthrie
(74) *Attorney, Agent, or Firm* — Device Patent LLC

(57) ABSTRACT

Disclosed is a vehicle supported wood splitter comprising a blade portion and a fixation portion extending from the blade portion. The blade portion comprises a generally upward facing cut edge situated between a primary deflector face and a secondary deflector face and wherein at least a portion of the fixation portion is sized and shaped to be received in a hitch receiver or similar apparatus of a vehicle such as an automobile, RV, camper, trailer, or UTV. Methods of use for various embodiments of the apparatus are described. In preferred embodiments, the wood splitting device is supported entirely by a vehicle's hitch receiver. Also disclosed in various embodiments is a kindling collection system, a guide system, and splitter forms adapted to one or more of casting, machining, and welding.

20 Claims, 17 Drawing Sheets

(56) References Cited

U.S. PATENT DOCUMENTS

| | | | | |
|---|---|---|---|---|
| 4,431,040 | A | 2/1984 | Friedrich et al. | |
| 4,446,898 | A | 5/1984 | Manteufel | |
| 4,453,580 | A | 6/1984 | Patten | |
| 4,782,867 | A | 11/1988 | Forsyth | |
| 4,782,868 | A | 11/1988 | Coller et al. | |
| 4,782,870 | A | 11/1988 | Duerr | |
| 4,800,937 | A | 1/1989 | Mangus | |
| 4,945,960 | A | 8/1990 | McCauley | |
| 5,245,902 | A | 9/1993 | Pereira | |
| 5,284,193 | A | 2/1994 | Mires et al. | |
| 5,520,105 | A | 5/1996 | Healy | |
| 5,575,319 | A | 11/1996 | Chick | |
| 6,112,784 | A | 9/2000 | Lough | |
| 6,390,162 | B1 | 5/2002 | Sahlem | |
| 6,453,958 | B1 | 9/2002 | Slavich | |
| 6,568,577 | B2 | 5/2003 | Baird et al. | |
| 6,601,746 | B2 | 8/2003 | Buckley et al. | |
| 6,763,864 | B2 | 7/2004 | Setlack et al. | |
| 6,886,551 | B2 | 5/2005 | Scherer et al. | |
| 7,096,901 | B2 | 8/2006 | Brazzola | |
| 7,107,982 | B1 | 9/2006 | Lechner | |
| 7,243,826 | B2 | 7/2007 | Darst | |
| 7,556,072 | B2 | 7/2009 | Koch | |
| 7,587,968 | B1 | 9/2009 | Roberts | |
| 7,756,072 | B1 | 7/2010 | Fenner et al. | |
| 7,913,726 | B1 | 3/2011 | Honnell | |
| 8,079,612 | B1 * | 12/2011 | Tambornino | B60D 1/241 280/506 |
| 8,668,000 | B2 | 3/2014 | Carrillo | |
| 8,689,778 | B1 | 4/2014 | Flores | |
| 2008/0073361 | A1 | 3/2008 | Brouard | |
| 2009/0229709 | A1 | 9/2009 | Babcock | |
| 2016/0107330 | A1 * | 4/2016 | Hutchinson | B26D 1/02 225/81 |
| 2016/0288362 | A1 * | 10/2016 | Campana, Sr. | B27L 7/06 |

* cited by examiner

VEHICLE SUPPORTED WOOD SPLITTER AND METHODS OF USE

This application claims priority to U.S. Provisional Patent Application No. 62/538,694 filed Jul. 29, 2017, the entire disclosure of which is hereby incorporated by reference and relied upon.

BACKGROUND

Technical Field

The invention relates generally to apparatus and methods for splitting wood, and more particularly to vehicle mounted apparatuses and methods for splitting wood.

Splitting wood is a common task performed by people around the world. The split wood is used typically in fires for heating of building structures, saunas, campfires, and for the enjoyment of fire places. Splitting wood, however, can be a difficult task and therefore there has been an abundance of prior art directed to machines of various sizes for this purpose. However, even the simplest of these devices are too large and complex and lead to poor body mechanics. The standard for splitting wood into kindling is the axe, however the axe has proved to be dangerous since the method typically involves swinging an axe blade toward a user's opposing hand stabilizing the log.

What is needed are log splitting devices and methods that are significantly safer than a hand axe, yet simple, effective, inexpensive, and highly portable.

SUMMARY OF THE INVENTION

Disclosed herein is an article of invention and methods of use for the splitting of wood such a logs into smaller pieces such as kindling. In preferred forms, the article of invention is a wood splitter mounted within a trailer hitch receiver of a vehicle. The trailer hitch receiver provides substantial support used by the apparatus to maintain its position during a wood splitting process. In other forms, the article of invention is mounted to the frame of a trailer such as a travel trailer. Like the trailer hitch receiver, the trailer frame provides substantial support used by the apparatus to maintain its position during a wood splitting process. The article of invention described herein may be used to split wood in any form. The terms 'log' and 'wood' are used generically to represent all wood forms including wood that has been exposed to some form of processing.

In one form, a wood splitter comprises a fixation portion and a blade portion and an optional guide portion.

In one form, a fixation portion of a wood splitter is housed within a hitch receiver that is fixed to a vehicle.

In one form, a wood splitter is supported entirely by a hitch receiver.

In one form, a wood splitter comprises a fixation bore on the fixation portion for receiving a hitch pin.

In one form, a wood splitter comprises a primary blade and an optional secondary blade.

In one form, a primary blade is at an oblique angle to the secondary blade such as 90 degrees.

In one form, a wood splitter is manufactured by one or more of machining and casting and forging.

In one form, one end of a log is placed on top of a blade portion of a wood splitter extending from a hitch receiver of a vehicle wherein the log is impacted on an opposing end thereby splitting the log when driven over a primary blade.

In one form, in one form a blade portion comprises a deflector portion below at least one of a primary blade and a secondary blade to create wedging forces during splitting.

In one form, a collector is positioned below a wood splitter to capture split wood pieces.

In one form, a fixation portion is sized and shaped to be received in one or more of a standard 1.25 inch and a 2 inch hitch receiver of a vehicle but may be custom sized.

In one form, a fixation portion is received in a splitter sleeve fixed to one or more of a trailer frame or bumper.

In one form, a fixation portion and a blade portion are formed from a body portion.

In one form, a fixation portion is formed from one or more of a solid bar and a tube and a plate.

In one form, one or more of a primary blade and optional secondary blade has a cut edge which may be sharpened.

In one form, a primary blade has a primary edge face and a secondary edge face that is vertical or sloped.

In one form, the primary edge and secondary edge face transition to respective primary and secondary deflector faces.

In one form, a primary edge and secondary edge face generally upward.

In one form, a cut edge is centered between sloping deflector faces of a blade portion.

In one form, a cut edge is offset between sloping deflector faces.

In one form, a fixation portion and other aspects of a body portion are defined by one or more of; a top face, a bottom face, a first side face, a second side face, proximal end face and a distal end face.

In one form a fixation face defines a fixation bore having a diameter for housing a hitch pin.

In one form, a blade portion comprises a blade extension for seating within a fixation recess.

In one form, a blade extension has one or more of a first side extension wall, a second side extension wall, an upper extension wall, and a lower extension wall.

In one form, fixation recess comprises one or more of; an upper recess wall, a lower recess wall, a first side recess wall, and a second side recess wall.

In one form, a fixation portion comprises a proximal tube wall and a distal tube wall terminating the ends.

In one form, a wood splitter comprises a guide portion.

In one form, a guide portion comprises a guide wall with guide surface thereon.

In one form, a guide portion comprises one or more of a first guide leg and a second guide leg.

In one form, a first guide leg transitions into a first guide foot.

In one form, a second guide leg transitions into a second guide foot.

In one form, a guide wall has a portion that is generally horizontal.

In one form, a guide surface is generally superior, parallel, and spaced from a cut edge.

In one form, a guide portion has a deflectable insertion.

In one form, a first guide foot is seated in a first guide receiver.

In one form, a second guide foot is seated in a second guide receiver.

In one form, a guide portion is pivotable.

In one form, the motion of a guide portion is limited by one or more of a first lock pin, a second lock pin, and a third lock pin.

In one form, a guide portion is one of L shaped and T shaped.

In one form, a guide portion comprises a pivot joint.

In one form, a body portion is formed generally square and elongate.

In one form, various components of a wood splitter are one or more of fastened and welded.

In one form, a wood splitter comprises a bottle opener.

In one form, a cut edge is one or more of linear, concave, and convex.

In one form, a blade portion comprises a removable edge portion.

In one form, a blade portion comprises a blade interlock for removing a removable edge portion.

In one form, a wood splitter comprises an operational configuration and a storage configuration.

In one form, a removable edge portion is removed from a blade portion in a storage configuration.

In one form, a guide wall is in the form of a ring wherein the ring is partially or fully enclosed and defines a guide aperture.

In one form, a wood splitter comprises a blade cover to minimize exposure to a blade portion when not in use.

In one form, a blade cover comprises one or more magnets.

In one form, a collector is positioned between a wood splitter and a ground surface.

In one form, wood pieces fall and are collected in a collector.

In one form a collector is inclined.

In one form, a blade portion is covered by a removable sleeve.

In one form, a wood splitter comprises a deflector saddle.

In one form, a wood splitter comprises a fixed or removable blade plate.

In one form, a blade plate comprises one or more blade slots.

In one form, a blade plate comprises one or more blade holes.

In one form, a cut edge is integrated into an upright wall of a tubular body portion.

In one form, a support wedge is used to provide support to a deflector plate.

In one form, a wood splitter is configured with a foldable guide that functions as a blade cover in a storage configuration.

In one form, a wood splitter comprises a deflector plate supported at an upper deflector support face.

In one form, a wood splitter comprises a blade plate secured to a second side face.

In one form, a wood splitter comprises a guide portion that is generally U-shaped.

In one form, a wood splitter comprises a joined tubular fixation portion and a blade plate.

In one form, a blade plate comprises a blade extension.

In one form, a wood splitter comprises a bottom face mounted deflector plate.

In one form, a fixation portion is secured to a vertical wall in a hitch receiver by a clamp post in combination with a tightened clamp nut.

In one form, a fixation portion is secured to a vertical wall in a hitch receiver by a clamp bolt threaded into a body portion of a wood splitter.

In one form, a wood splitter is absent a deflector face.

In one form, a deflector plate is formed as an extension of a body portion by formation of a deflector bend.

In one form, a fixation portion comprises a profile extension for adding stability.

In one form, a blade portion including deflector plate are formed from a monolithic body portion.

In one form, a blade portion comprises one or more of a first bumper and a second bumper situated on an end of the blade portion.

In one form, a wood splitter comprises an adjustable height blade portion.

In one form, a blade portion is secured to a superior end of a height strut which is removably coupled to a fixation portion.

In one form, height strut comprises a plurality of spaced height apertures.

In one form, an inferior end of a height strut comprises a ground pad.

In one form, a wood splitter comprises a fixation portion configured for capture over a standard hitch ball.

In one form, a wood splitter comprises a fixation portion configured for capture over a hitch ball secured to a ball mount.

In one form, a wood splitter comprises a blade housing in the form of a cylindrical tube.

In one form, a blade housing comprises a base surface at an inferior end.

In one form, a blade housing comprises a pair of opposed perch surfaces at a superior end.

In one form, a blade housing comprises opposed slope surfaces.

In one form, a blade portion comprises a blade plate.

In one form, a blade portion comprises a pair of opposed deflector plates.

In one form, a blade portion comprises opposed deflector plates and one or more cut edge formed monolithically.

In one form, a primary deflector face and a secondary deflector face intersect at a cut edge.

In one form, a blade plate is removable.

In one form, a wood splitter is placed over a hitch ball such that the hitch ball is confined within a ball space within a fixation portion of the wood splitter.

In one form, a base surface of a wood splitter fixation portion is supported by one or more of a base pod of a ball mount and a hitch ball base.

In one form, a fixation portion of a wood splitter is captured over a reverse side of a standard hitch ball secured to a ball mount.

In one form, a ball mount and hitch ball serve to support a wood splitter.

In one form, a wood splitter comprises a modified hitch ball comprising a rod capture.

In one form, a wood splitter comprises a blade rod joining a fixation portion to a hitch ball.

In one form, a wood splitter is configured for use as both a hand axe and as a hitch receiver mounted wood splitter.

In one form, a hitch coupler couples an axe handle to a hitch receiver.

In one form, a hitch coupler comprises a generally square coupler outer surface sized to fit in a corresponding hitch receiver.

In one form, a hitch coupler comprises a handle cavity for occupation by an axe handle.

In one form, a wood splitter is configured for use when mounted to one or more of; a trailer frame, a trailer tongue, a bumper.

In one form, a wood splitter is rotated between an operational configuration (mode) and a storage configuration.

In one form, a wood splitter is housed within a splitter sleeve in a storage configuration.

In one form, a wood splitter is removed from a splitter sleeve in a storage configuration (mode).

In one form, a splitter sleeve is part of a bracket for mounting to a trailer frame or trailer tongue.

In one form, a fixation portion of a wood splitter comprises a stem with optional threads.

In one form, a stem of a wood splitter fixation portion is housed in a frame hole or the hole of a holed plate extending from a trailer frame or trailer tongue.

In one form, an interchangeable wood splitter is part of a kit that includes interchangeable trailer balls (hitch balls).

In one form, an interchangeable wood splitter is an accessory to an interchangeable hitch ball system.

In one form, a fixation portion of a wood splitter is configured for mounting to a structure such as a ball mount, trailer frame, bumper, or intermediate bracket attached to these structures.

In one form, a fixation portion comprises a female cavity that is threaded to accept a blade lock bolt.

In one form, a fixation portion comprises a threaded stem for capture by a hitch ball nut.

In one form, a fixation portion comprises an unthreaded stem whereby the wood splitter utilizes gravity to remain fixed to an anchor.

In one form, a wood splitter comprises one or more of: an upper window, a lower window, an upper chamber, and a lower chamber.

In one form, a wood splitter comprises a ball space sized and shaped for occupation by a hitch ball in a captured ball configuration.

In one form, a fixation portion of a wood splitter is configured to secure fastener or post in a posted configuration and by positioning over a hitch ball in a captured ball configuration.

In one form, one or more flutes may extend into a fixation portion.

In one form, a log boss may be located at one end of a cut edge for quick positioning of a log.

In one form, a blade cover is provided for covering and uncovering a cut edge of a blade portion.

In one form, a blade cover hangs from a guide portion in an operational mode.

In one form, a blade cover is flipped up in an operational mode.

In one form, a wood splitter comprises a fixation portion in the form of one of a square tube and square bar with a blade portion having a blade extension fixed to an inside or outside vertical surface of the tube or bar.

In one form, a wood splitter comprises a guide surface of a guide portion that is adjustable in distance from a cut edge of a blade portion.

In one form, a receiver block extends from a body portion of a hitch splitter for housing a first guide receiver.

In one form, a wood splitter has a guide portion that is switchable between at least two of the following configurations (modes): an open mode, a storage mode, an operational mode, an and an absent mode.

In one form, a guide portion comprises a faceted collar.

In one form, a faceted collar interfaces with a block face to determine position of a guide portion.

In one form, a guide portion is in the form of a turret.

In one form, a guide portion has a generally circular guide wall with a generally vertical first guide leg extending from it. An L-shaped prong extends between the first guide leg and another portion of the guide wall.

In one form, a guide portion is vertically adjustable above the cut edge.

In one form, a body portion comprises one or more of; a fixation cavity, a primary blade cavity, and a secondary blade cavity.

In one form, a wood splitter comprises a tubular fixation portion fixed to a casted or machined blade portion.

In one form, a wood splitter comprises a solid bar fixation portion fixed to a casted or machined blade portion.

In one form, a method for splitting wood comprises the step of obtaining a wood splitter having a blade portion and a fixation portion extending from the blade portion and securing the fixation portion in a hitch receiver of a vehicle.

In one form, a method for splitting wood comprises the step of obtaining a wood splitter having an internal ball space and placing it over a hitch ball such that the hitch ball occupies the ball space.

In one form, a standard jack stand is converted into a wood splitter utilizing a cover blade supported by a portion of a jack stand lift arm captured therein.

In one form, a standard jack stand is converted into a wood splitter whereby the standard jack stand lift arm is substituted with a jack stand blade arm.

BRIEF DESCRIPTION OF THE SEVERAL VIEWS OF THE DRAWINGS

These and other features and advantages of the present invention will become more readily appreciated when considered in connection with the following detailed description and appended drawings, wherein each Figure is according to one or more embodiments shown and described herein, and wherein:

FIG. 109 is a perspective view of a wood splitter configured for a captured ball configuration;

FIG. 110 is a perspective view of a wood splitter configured for a captured ball configuration;

FIG. 111 is a cross-sectional view of the wood splitter illustrated in FIG. 109;

FIG. 112 is a perspective view of a guide portion in the form of a plate with extended superior lobe;

FIG. 113 is a perspective view of a wood splitter with a novel guide portion;

FIG. 114 is an exploded view of the wood splitter of FIG. 113;

FIG. 115 is an end view of the wood splitter of FIG. 113;

FIG. 116 is a perspective view of a wood splitter with an adjustable form of the guide portion illustrated in FIG. 113;

FIG. 117 is a perspective view of a wood splitter having a novel guide portion;

FIG. 118 is an exploded perspective view of the wood splitter of FIG. 117;

FIG. 119 is a perspective view of a wood splitter having a novel adjustable guide portion and cut blade cover;

FIG. 120 is a perspective view of a wood splitter with blade cover in an uncovered position;

Figure 121:
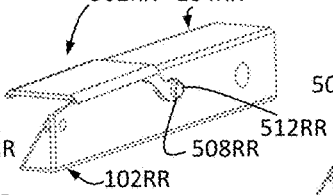
Figure 122:
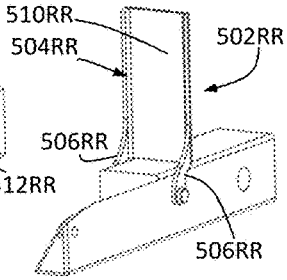
Figure 123:
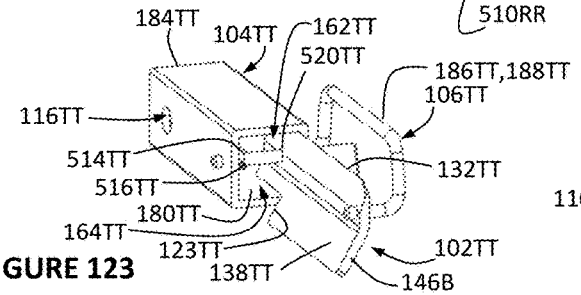
Figure 124:
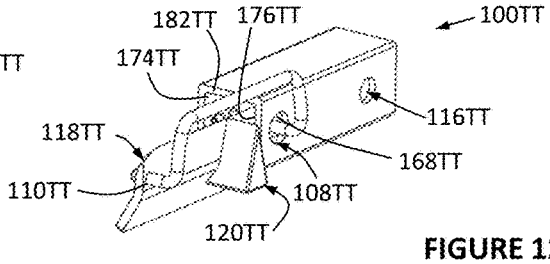
Figure 125:
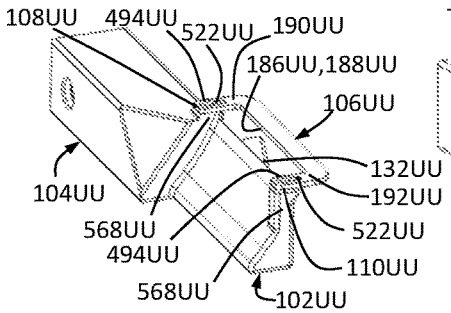
Figure 126:
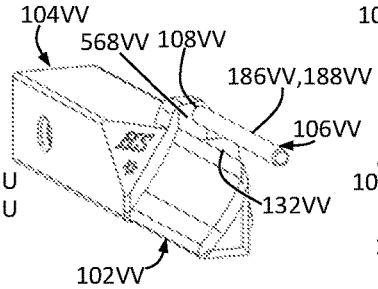
Figure 127:
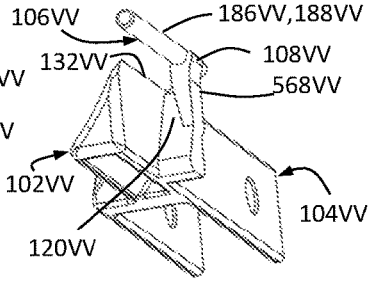
Figure 128:
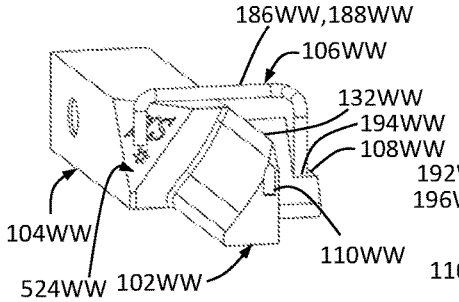
Figure 129:
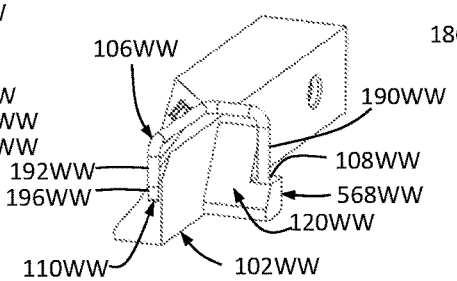
Figure 130:
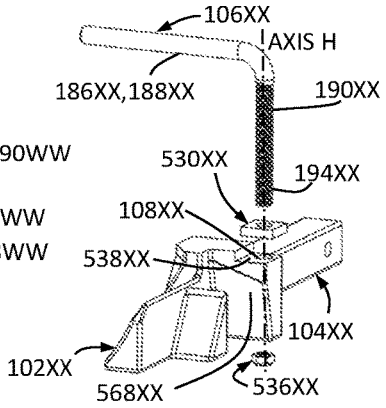
Figure 131:
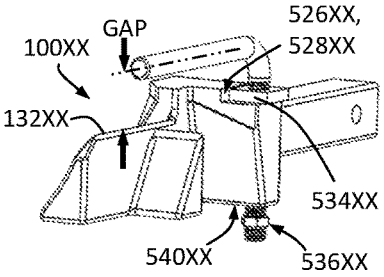
Figure 132:
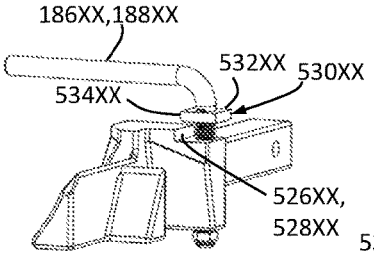
Figure 133:
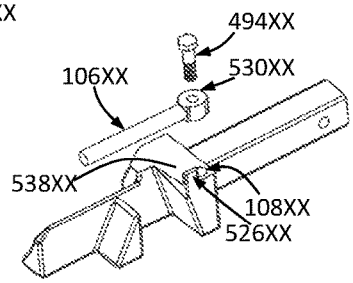
Figure 134:
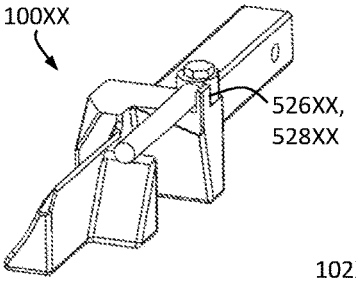
Figure 135:
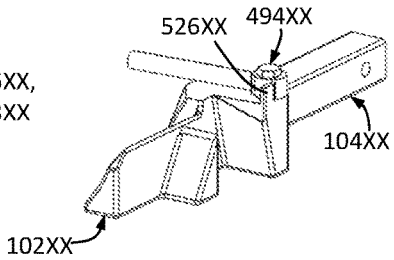
Figure 136:
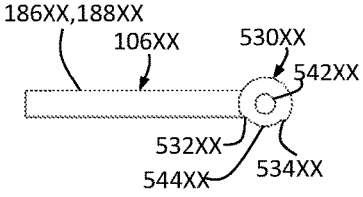
Figure 137:
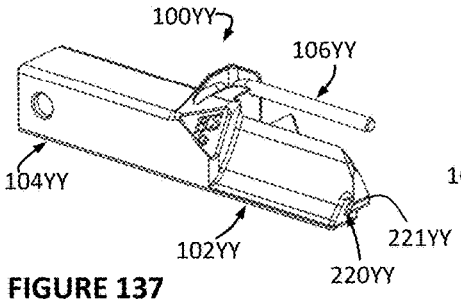
Figure 138:
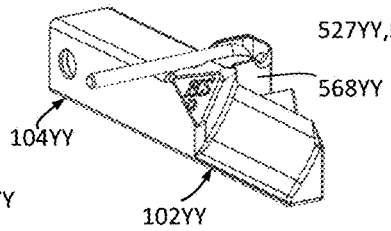
Figure 139:
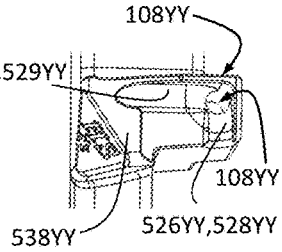
Figure 140:
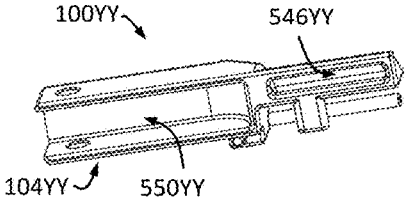
Figure 141:
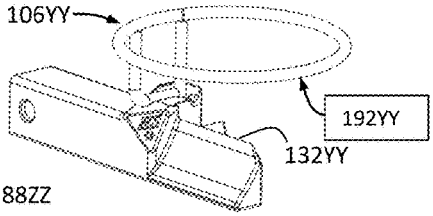
Figure 142:
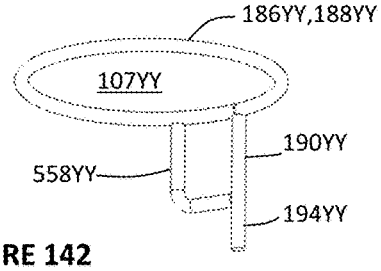
Figure 144:
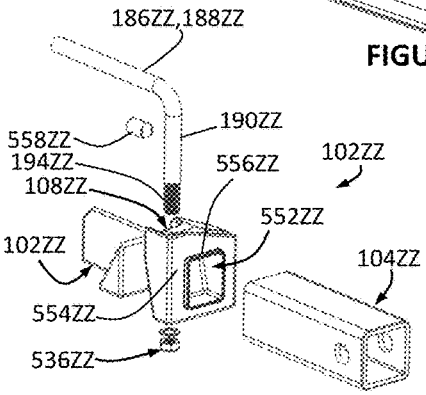
Figure 143:
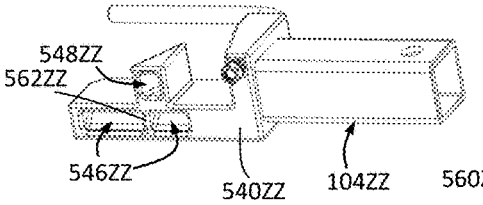
Figure 146:
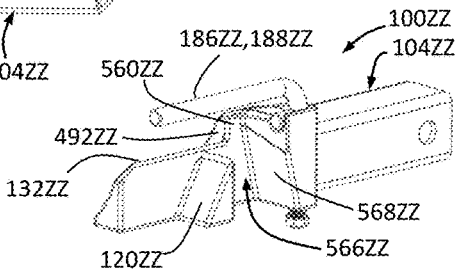
Figure 147:
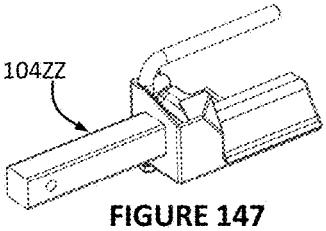
Figure 145:
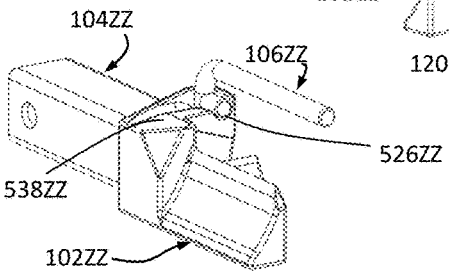
Figure 148:
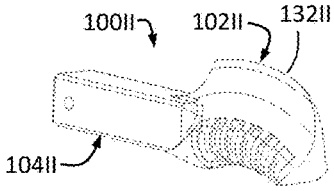
Figure 149:
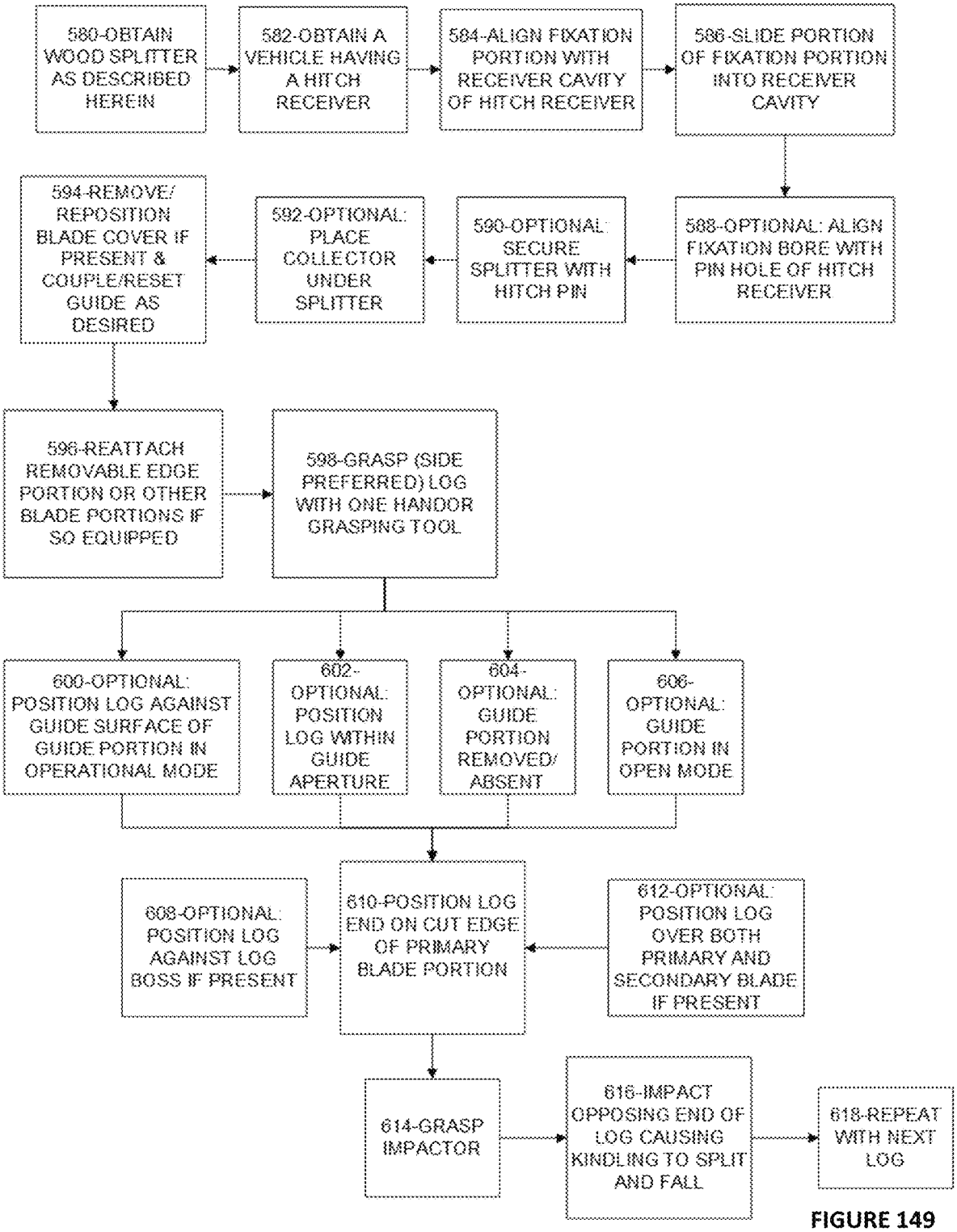
Figure 150:
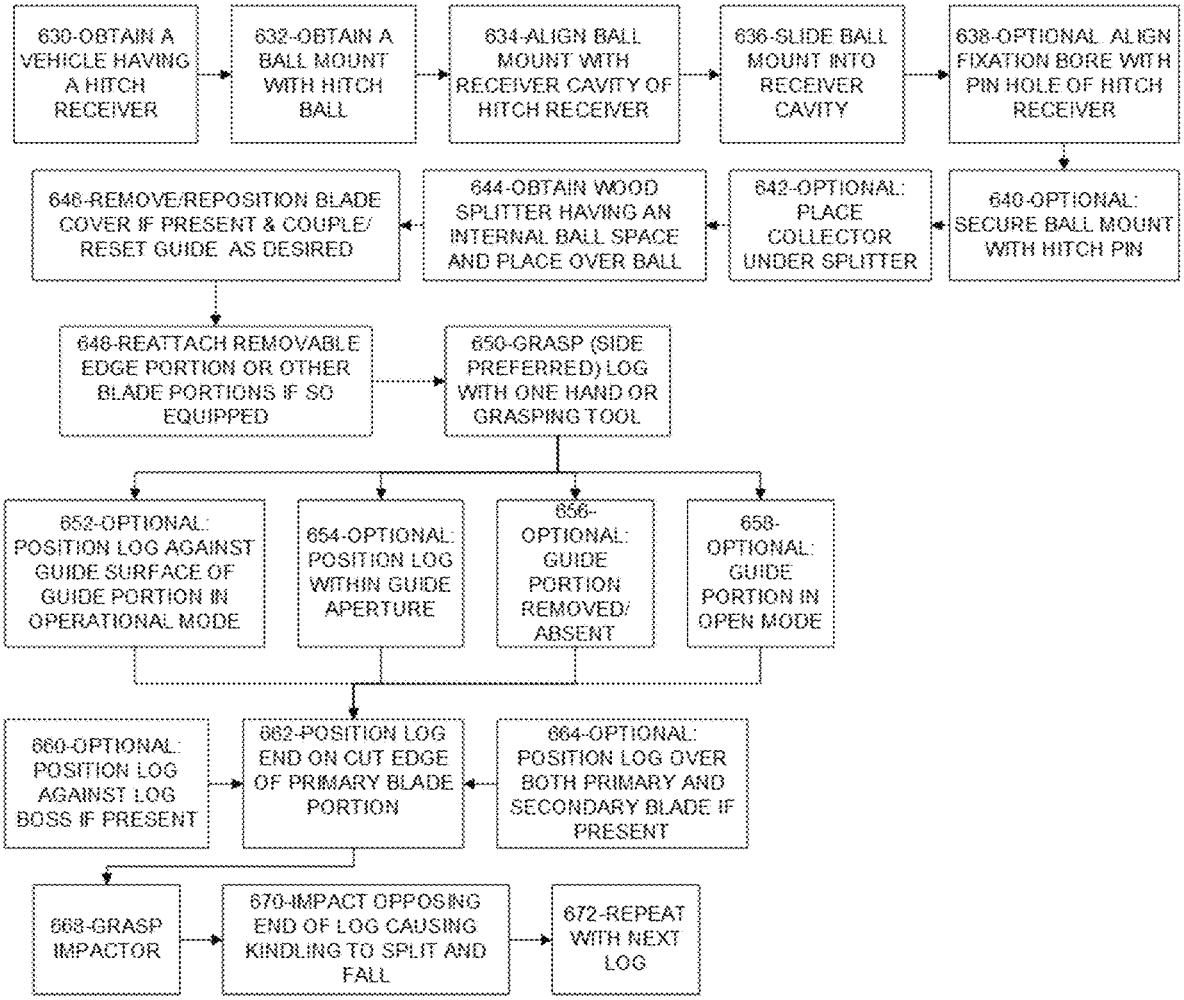
Figure 151:
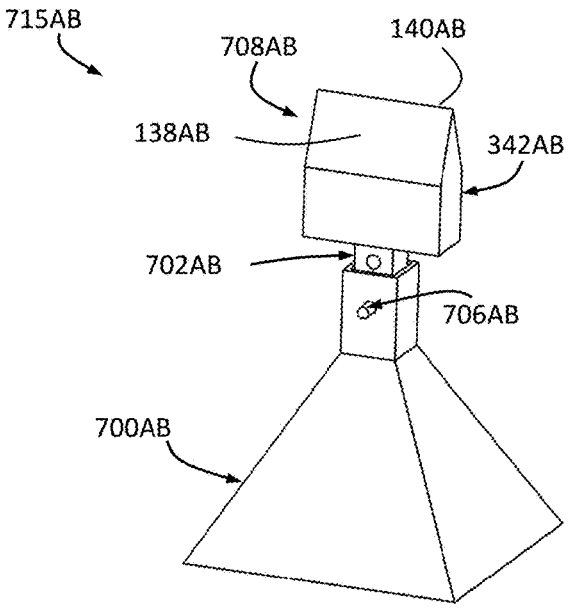
Figure 152:
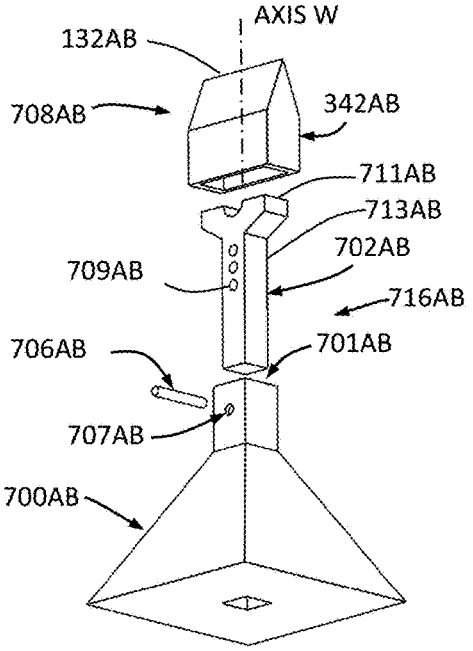
Figure 153:
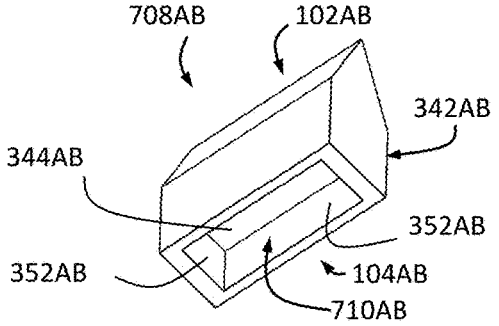
Figure 154:
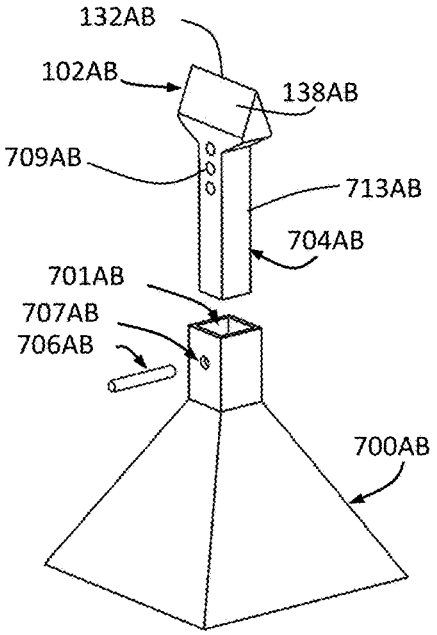
Figure 155:
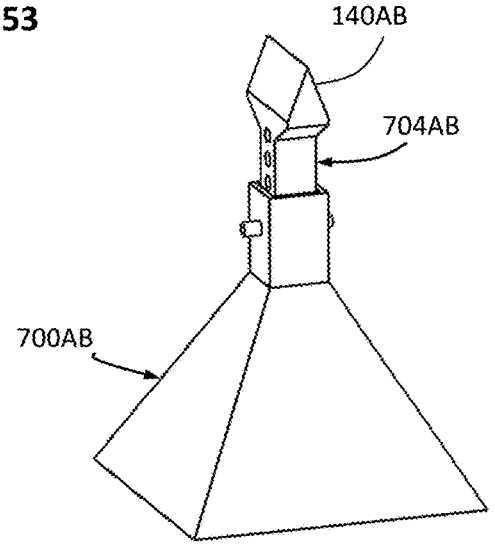

FIG. 121 is a perspective view of a wood splitter with blade cover in a covered position;

FIG. 122 is a perspective view of a wood splitter with blade cover in an uncovered position;

FIG. 123 is a perspective view of a wood splitter with novel guide portion and construction;

FIG. 124 is an opposing perspective view of the wood splitter of FIG. 123;

FIG. 125 is a perspective view of a wood splitter with a novel guide portion;

FIG. 126 is a perspective view of a wood splitter with a novel guide portion;

FIG. 127 is a perspective view of a wood splitter with a novel guide portion;

FIG. 128 is a perspective view of a wood splitter with a novel guide portion;

FIG. 129 is a perspective view of the wood splitter of FIG. 128 with guide portion in a different mode;

FIG. 130 is an exploded perspective view of a wood splitter with a novel guide portion;

FIG. 131 is a perspective view of the wood splitter of FIG. 130 in an operational mode;

FIG. 132 is a perspective view of the wood splitter of FIG. 130 about to set into an open mode;

FIG. 133 is a perspective view of a wood splitter having a novel guide portion;

FIG. 134 is a perspective view of the wood splitter of FIG. 133 in an operational configuration;

FIG. 135 is a perspective view of the wood splitter of FIG. 133 in an open configuration;

FIG. 136 is a top view of a guide portion of the wood splitter of FIG. 133;

FIG. 137 is a perspective view of a novel wood splitter with integrated bottle opener in an operational mode;

FIG. 138 is a perspective view of the wood splitter of FIG. 137 in an open mode;

FIG. 139 is a partial close-up view of the first guide receiver of the wood splitter of FIG. 137;

FIG. 140 is a perspective view of the wood splitter of FIG. 137 showing various cavities;

FIG. 141 is a perspective view of the wood splitter of FIG. 137 using a novel guide portion;

FIG. 142 is a perspective view of the guide portion of the wood splitter of FIG. 141;

FIG. 143 is a perspective view of a novel wood splitter;

FIG. 144 is an exploded view of the wood splitter of FIG. 143;

FIG. 145 is a different perspective view of the wood splitter of FIG. 143;

FIG. 146 is a different perspective view of the wood splitter of FIG. 143;

FIG. 147 is a perspective view of a wood splitter having a solid fixation portion;

FIG. 148 is a perspective view of a wood splitter having a curved blade portion;

FIG. 149 is a diagram of an embodiment of one method of splitting wood utilizing a hitch receiver supported wood splitter as described herein;

FIG. 150 is a diagram of an embodiment of one method of splitting wood utilizing a wood splitter having an internal ball space in conjunction with a ball mount and hitch ball;

FIG. 151 is a perspective view of a wood splitter in the form of a jack stand with a novel cover blade accessory;

FIG. 152 is an exploded view of the jack stand with cover blade accessory of FIG. 151;

FIG. 153 is a perspective view of a cover blade;

FIG. 154 is an exploded view of a wood splitter in the form of a jack stand with a jack stand lift arm substituted with a jack stand blade arm;

FIG. 155 is a perspective view of the wood splitter illustrated in FIG. 154.

DETAILED DESCRIPTION OF SELECTED EMBODIMENTS

Select embodiments of the article of invention will now be described with reference to the Figures. Like numerals indicate like or corresponding elements throughout the several views. Various embodiments having like or corresponding elements are distinguished by letters (i.e. 100A, 100B, 100C, 100AA). The terminology used in the description presented herein is not intended to be interpreted in any limited or restrictive way, simply because it is being utilized in conjunction with detailed description of certain specific embodiments of the invention. Furthermore, embodiments of the invention may include several novel features, no single one of which is solely responsible for its desirable attributes or which is essential to practicing the invention described herein.

FIGS. 1 through 4 illustrate an embodiment of the article of invention. In this embodiment, a wood splitter 100A is illustrated housed within a hitch receiver 126 that is fixed to a vehicle 127 such as for example, a car, a truck, a UTV, and trailer. Although not required, a hitch pin 112 (which may take other forms such as a bolt) is extended through a hole bored through a hitch receiver 126 and passes through a fixation bore 116A on a fixation portion of wood splitter 100A. A hitch pin retainer 114 may be used to secure hitch pin 112 in position. In this embodiment, wood splitter 100A comprises a primary blade 118A and an optional secondary blade 120A extending at an oblique angle from the primary blade. In preferred forms, the oblique angle is generally 90 degrees. As noted in FIG. 2, the blade portion 102A of the wood splitter is spaced sufficiently from the vehicle thereby avoiding damage to the vehicle during splitting actions. In this embodiment and others, the wood splitter 100A is manufactured from metal, preferably steels and their alloys. In some embodiments the steels are stainless steels. However, any material having sufficient strength, ductility, and hardness may be used such as aluminum, and aluminum alloys. In some places, polymers may be used. Individual parts and assemblies of the article of invention may be formed by one or more of a range of manufacturing processes including machining, casting, and forging. In some embodiments, the article of invention is in the form of a single casted or forged part.

Figure 1:
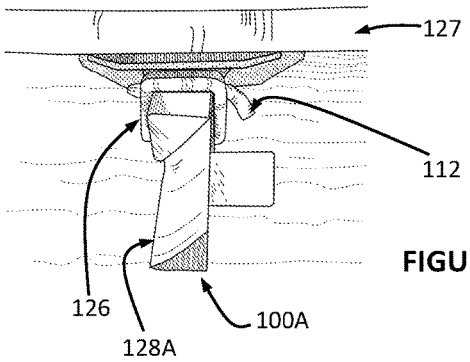
FIG. 1 depicts a top perspective view of a wood splitter mounted within a hitch receiver of a truck.
Figure 2:
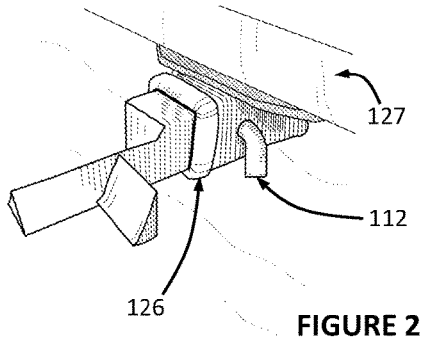
FIG. 2 depicts a side perspective view of a wood splitter mounted within a hitch receiver of a truck.
Figure 3:
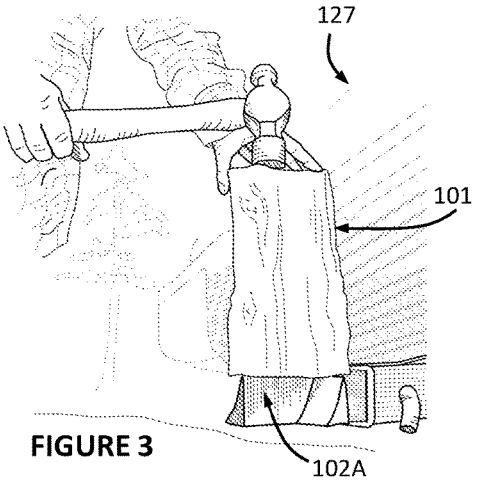
FIG. 3 depicts a side perspective view of a user using a hammer to impact a log against a wood splitter mounted within a hitch receiver of a truck.
Figure 88:
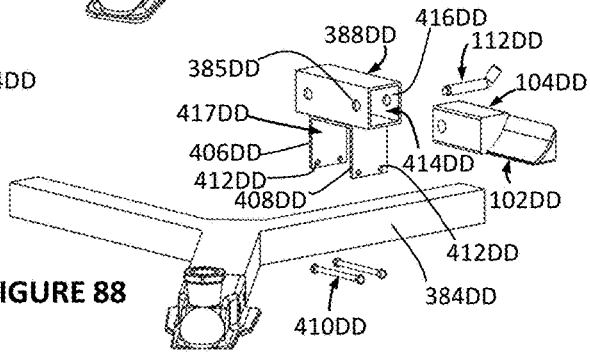
FIG. 88 depicts a top perspective exploded view of the wood splitter of FIG. 86.

FIG. 3 illustrates a user positioning a log on a blade portion 102A of a wood splitter 100A secured within a hitch receiver 126 of a vehicle such as a truck. The user holds the side of a log 101 or other wood with one hand and impacts the top of the log with an impact tool such as a hammer. The impact causes the log 101 to be driven down over a primary blade 118A (and secondary blade 120A if so equipped) and also over a deflector portion 130A of the splitter. As a consequence of this, the log 101 is split into smaller pieces. In some embodiments, a collector (such as 258I in FIG. 30) is positioned below a wood splitter to capture the smaller wood pieces (also referred to as kindling 103) as they fall from the wood splitter. A wood splitter according to embodiments of this invention are preferably configured for being received in a standard 2 inch×2 inch hitch receiver and in other embodiments for a standard 1.25 inch×1.25 inch hitch receiver. However, it is conceived the device could be used in any other custom sized receiver. In addition, the disclosed wood splitter embodiments may be received in parts functionally equivalent to hitch receivers for splitting purposes such as splitter sleeve 388DD (FIG. 88).

Referring back to FIG. 1, it illustrates one embodiment of the article of invention. In this embodiment a wood splitter comprises a fixation portion 104A and a blade portion 102A formed from a body portion 128A. The fixation portion 104A is generally configured to be received in a hitch receiver 126 secured to a vehicle 127. In this embodiment, fixation portion 104A is in the form of a solid steel bar. The blade portion 102A comprises a primary blade 118A and in this embodiment also comprises a secondary blade 120A extending generally perpendicular to primary blade 118A. The primary blade 118A and secondary blade both have a cut edge 132A with a primary edge face 134A and a secondary edge face 136A. One or more of a primary edge face and a secondary edge face may be vertical or sloped. In some embodiments, a primary edge face 134A and secondary edge face 136A seamlessly transition into a primary deflector face 138A and secondary deflector face 140A of a deflector portion 130A whereas in other embodiments there is a distinct transition such as a change in angle between them. In some embodiments, the primary edge faces and secondary edge faces are separated from the primary and secondary deflector faces by respective primary and secondary transition faces.

Figure 4:
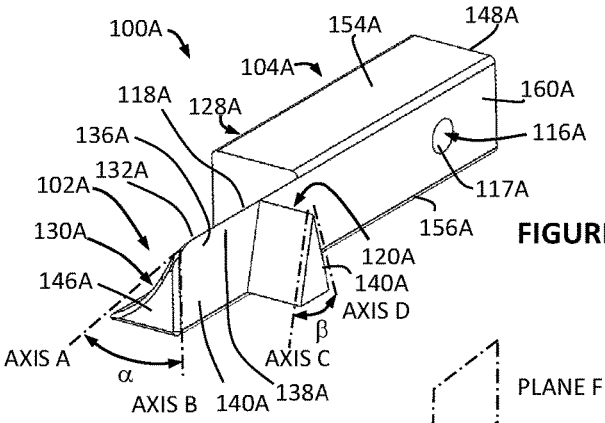
FIG. 4 depicts a top perspective view of a wood splitter with secondary blade for mounting within a hitch receiver of a vehicle.

Edge faces, transition faces, and deflector faces may assume a variety of profiles not limited to generally flat, concave, and convex. In preferred embodiments, the aforementioned primary and secondary blade components face generally upward however in other embodiments the blade portions are vertical or downward. Distances between opposed edge, transition, and deflector faces increase moving inferiorly from the cut edges as illustrated in FIG. 4. Axis A and axis B extend from a cut edge 132A and generally follow the included surfaces below thereby defining a slope angle alpha.

Figure 5:
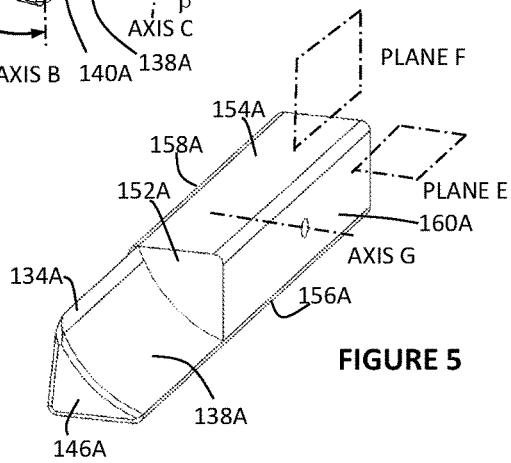
FIG. 5 depicts a top perspective view of a wood splitter for mounting within a hitch receiver of a vehicle.

In some embodiments, a cut edge of a blade portion is generally centered between sloping faces of a blade portion. In other embodiments such as illustrated in FIGS. 4 and 5, a cut edge 132A is offset to one side of body portion 128A. This offset tends to create steeper incline faces on one side versus the other. A cut edge offset to the right (FIG. 4) is preferable for right handed users, whereas a cut edge offset to the left (FIG. 5) is preferable for left hand users. Some embodiments include two cut edges so configured such that by rotating a wood splitter 90 degrees within a hitch receiver, a user may use a single wood splitter to perform left handed and right handed splitting.

Embodiments having a secondary blade 120A, it is preferable the second blade also includes one or more opposed primary and secondary edge faces, transition faces, and deflector faces. Distances between opposed edge, transition, and deflector faces increase moving inferiorly from the cut edge of a secondary blade as represented by the angle β (FIG. 4) between axis C and axis D each extending down opposing slopes.

In this and other embodiments, a fixation portion 104A and other aspects of a body portion 128A may be defined by a top face 154A, a bottom face 156A, a first side face 158A, and a second side face 160A. A proximal end face 146A and a distal end face 148A are positioned at the opposing ends. A fixation face 117A defines a fixation bore 116A extending between first side face 158A and second side face 160A. Fixation bore 116A has an elongate axis G and is characterized by a diameter sufficient to house a hitch pin 112. It is preferred that fixation bore 116A is generally aligned with a horizontal mid plane (plane E) and is generally perpendicular to first and second side faces 158A and 160A. Embodiments configured to accommodate both left handed and right handed users may include a secondary fixation bore (not shown) extending between bottom face 156A and top face 154A. A distal blade face 152A may extend between blade portion 102A and fixation portion 104A.

Figure 4A:
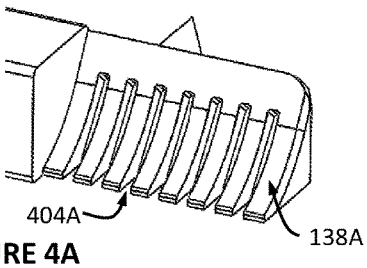
FIG. 4A depicts a partial top perspective view of a blade portion of a wood splitter having a plurality of vertical relief grooves extending along a deflector face.

FIG. 4A illustrates a blade portion of the wood splitter of FIG. 4 having a plurality of relief grooves 404A extending into a primary deflector face 138A of a blade portion 102A. The relief grooves 404A may be utilized in a variety of wood splitter embodiments having either primary or secondary deflector faces.

Figure 6:
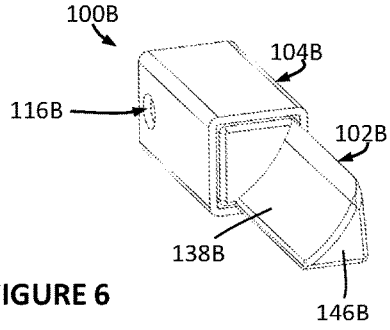
FIG. 6 depicts a top perspective view of a wood splitter having a substantially solid blade portion secured in a substantially tubular fixation portion for mounting within a hitch receiver of a vehicle.
Figure 7:
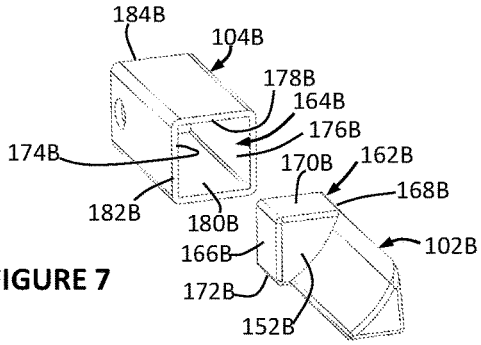
FIG. 7 depicts a top perspective exploded view of the wood splitter of FIG. 6 having a substantially solid blade portion secured in a substantially tubular fixation portion for mounting within a hitch receiver of a vehicle.
Figure 8:
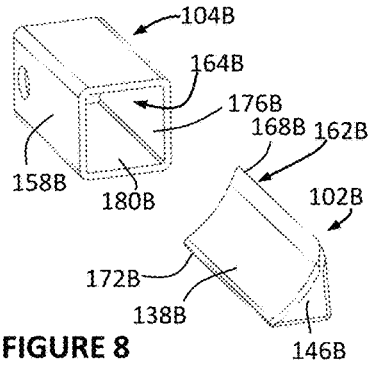
FIG. 8 depicts a top perspective view of a wood splitter having a substantially solid blade portion secured in a substantially tubular fixation portion for mounting within a hitch receiver of a vehicle.

FIGS. 6-8 illustrates yet another embodiment of the article of invention. In this embodiment of a wood splitter 100B, a blade portion 102B comprises a blade extension 162B configured for seating within fixation recess 164B and held by one or more of; fasteners such as screws and pins, and welds. Blade extension 162B is defined by one or more of; a first side extension wall 166B, a second side extension wall 168B, an upper extension wall 170B, and a lower extension wall 172B. Fixation recess 164B comprises one or more of; an upper recess wall 178B, a lower recess wall 180B, a first side recess wall 174B, and a second side recess wall 176B. Fixation portion 104B comprises a proximal tube wall 182B and a distal tube wall 184B terminating the ends. As illustrated in FIG. 8, in some embodiments blade portion 102B does not comprises a four sided blade extension whereas the blade extension is two sided and is instead seated on second side extension wall 168B and lower extension wall 172B against respective second side recess wall 176B and lower recess wall 180B.

Figure 9:
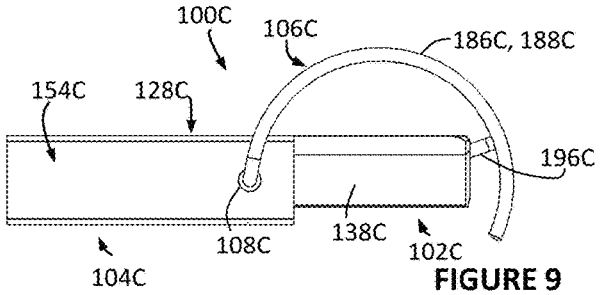
FIG. 9 depicts a top view of a wood splitter having a guard portion seated within guard receivers and wherein the wood splitter is configured for mounting within a hitch receiver of a vehicle.
Figure 10B:
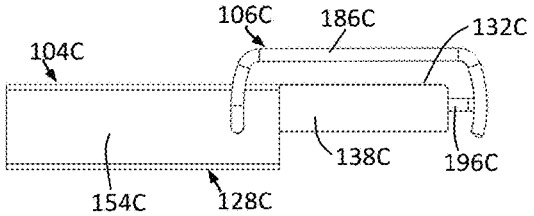
FIG. 10B depicts a top view of a wood splitter having a guide portion seated within guide receivers similar to FIG. 9. The guide portion includes a generally linear wall portion that is substantially parallel a cut edge of a blade portion. The wood splitter is configured for mounting within a hitch receiver of a vehicle.
Figure 10A:
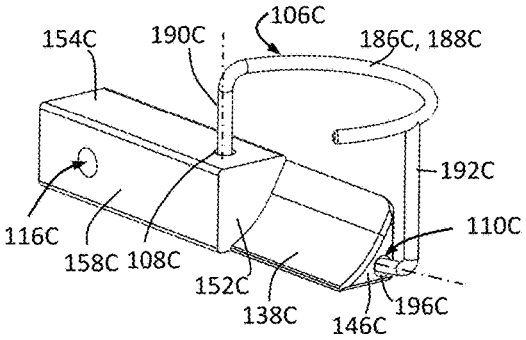
FIG. 10A depicts a top perspective view of the wood splitter illustrated in FIG. 9.

FIGS. 9 and 10A illustrate another embodiment of the article of invention equipped with a guide portion. In this embodiment, guide portion 106C comprises a guide wall 186C having a guide surface 188C formed thereon. Extending from guide wall 186C is a first guide leg 190C which is spaced from a second guide leg 192C. Body portion 128C is equipped with one or more guide receivers. The guide receivers may be in the form of a bored hole or may assume other forms capable of securing one or more guide legs and guide feet if present. In this embodiment, wood splitter 100C comprises a first guide receiver 108C disposed in top face 154C and a second guide receiver 110C disposed in proximal end face 146C however the guide receivers may be positioned at other faces such as a second side face. As illustrated here, a guide leg may include a guide foot portion such as the second guide foot 196C which is housed within second guide receiver 110C. Each guide receiver may comprise a radial guide face defining the walls of the bore and an end guide face at the bottom of the bore.

Figure 10C:
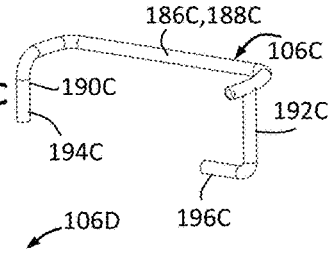
FIG. 10C depicts a top perspective view of the guide portion of FIG. 10A.

FIG. 10B illustrates a variation of the guide portion 106C illustrated in FIG. 9. The embodiment in FIG. 9 has a generally horizontal guide wall 186C with guide surface 188C formed thereon having a curved or semi-circular shape. In contrast, guide portion 106C in FIG. 10C comprises a generally horizontal guide wall 186C with guide surface 188C that is generally linear along a portion adjacent cut edge 132C.

Guide portion 106C in FIGS. 9, 10A, 10B, and 10C are configured to have a deflectable insertion. Therefore, to attach guide portion 106C to body portion 128C, first guide leg 190C is inserted in first guide receiver 108C, then guide portion 106C is pivoted such that second guide foot 196C is near second guide receiver 110C. The user applies a force to second guide leg 192C to deflect it far enough to clear proximal end face 146C until it can be aligned with second guide receiver 110C. The user then releases second guide leg 192C thereby allowing it to spring into second guide receiver 110C thus securing it in position. A reverse of these steps are used to remove guide portion 106C from body portion 128C.

Figure 11:
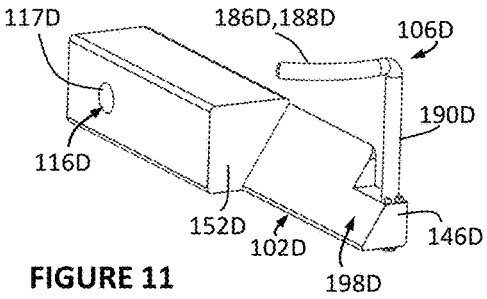
FIG. 11 depicts a top perspective view of a wood splitter having a guard portion seated within a guard receiver and wherein the wood splitter is configured for mounting within a hitch receiver of a vehicle.
Figure 13:
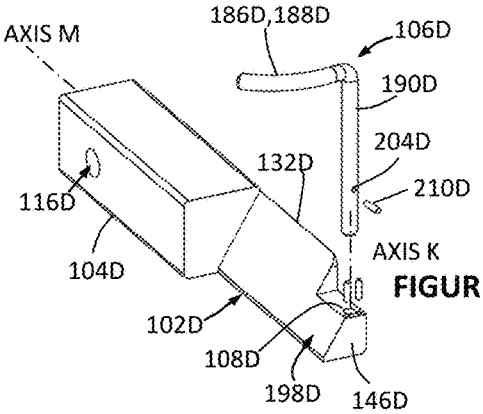
FIG. 13 depicts a partial exploded top perspective view of the wood splitter of FIG. 12.
Figure 12:
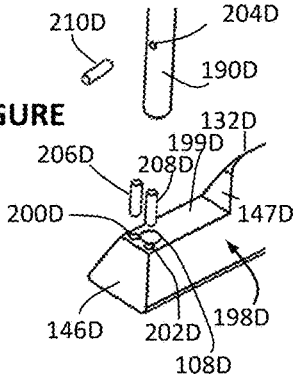
FIG. 12 depicts an exploded top perspective view of the wood splitter of FIG. 11.

FIGS. 11-13 illustrates another embodiment of the article of invention also equipped with a guide portion 106D. In this embodiment, a proximal end of blade portion 102D comprises a guide boss 198D configured with a first guide receiver 108D positioned generally vertical along axis K in this embodiment and disposed in a generally horizontal positioned guide boss face 199D. A second proximal end face 147D transitions between guide boss 198D and cut edge 132D. First pin recess 200D houses first lock pin 206D, and second pin recess 202D houses second lock pin 208D and third pin recess 204D in first guide leg 190D houses third lock pin 210D. When first guide leg 190D is inserted into first guide receiver 108D, motion of guide portion 106D is limited by third lock pin 210D being captured between first lock pin 206D and second lock pin 208D. In addition, third lock pin 210D may be used to set first guide leg 190 vertical position within first guide receiver 108D. In this embodiment, guide portion 106D is an "L" shape. Guide portion 106D may be configured to lift out and be removed by the user, or may be fixed within by a pin, screw, weld or other means. For example, a fourth lock pin 214D can be seated within fourth pin recess 212D at the inferior end of first guide leg 190D to limit travel.

Figure 14:
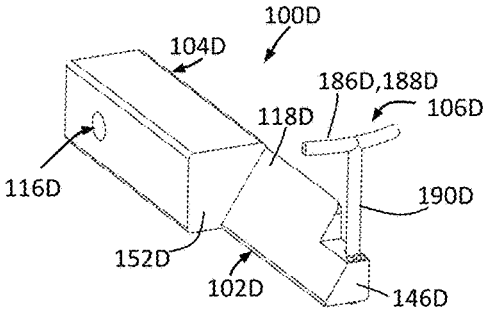
FIG. 14 depicts a top perspective view of a wood splitter having a guard portion seated within a guard receiver and wherein the wood splitter is configured for mounting within a hitch receiver of a vehicle.
Figure 15:
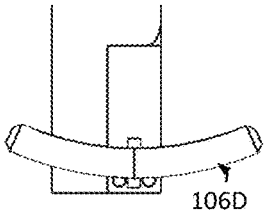
FIG. 15 depicts a partial top view of a wood splitter having a guard portion seated within a guard receiver and wherein the wood splitter is configured for mounting within a hitch receiver of a vehicle.
Figure 16:
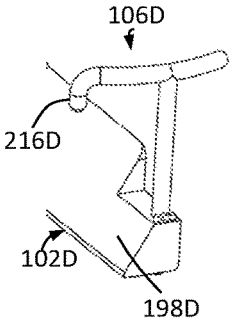
FIG. 16 depicts a partial top perspective view of a wood splitter having a guard portion with softened end seated within a guard receiver and wherein the wood splitter is configured for mounting within a hitch receiver of a vehicle.
Figure 17:
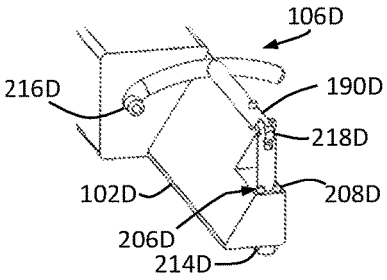
FIG. 17 depicts a partial top perspective view of a wood splitter having a collapsible guard portion seated within a guard receiver and wherein the wood splitter is configured for mounting within a hitch receiver of a vehicle.
Figure 18:
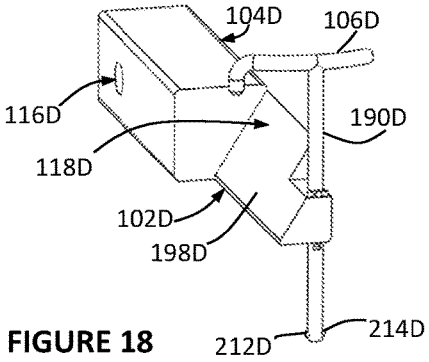
FIG. 18 depicts a top perspective view of a wood splitter having a guard portion seated within a guard receiver in an operational mode and wherein the wood splitter is configured for mounting within a hitch receiver of a vehicle.

FIG. 14 illustrates a similar wood splitter 100D embodiment however, guide portion 106D is in the shape of a "T". The shape of guide portion 106D may be fashioned into a wide range of shapes. FIG. 15 illustrates a top view of a "T" shaped guide portion 106D. FIG. 16 illustrates a partial view of a "T" shaped guide portion having a buffer leg 216D to soften contact by a user. FIGS. 17 and 18 illustrate an embodiment wherein a first guide leg 190D comprises a pivot joint 218D thus providing an option to fold a superior portion of a guide portion 106D down over primary blade 118D in a storage mode thereby reducing the profile and shielding a user from accidental harm. During operation, guide portion 106D is lifted upright and lowered into first guide receiver 108D consequently aligning pivot joint 218D along axis K and locking it as illustrated in FIG. 18. Third lock pin 210D holds the vertical position.

Figure 19:
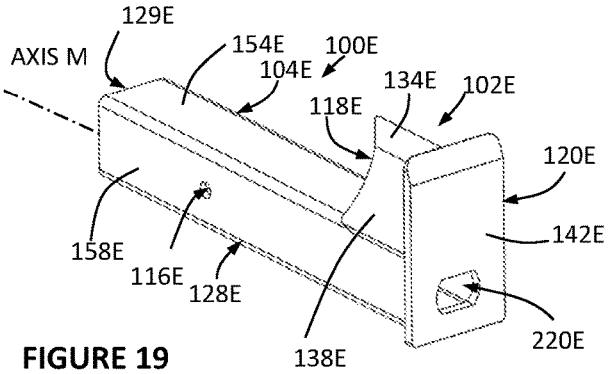
FIG. 19 depicts a top perspective view of a wood splitter with secondary blade for mounting within a hitch receiver of a vehicle.
Figure 20:
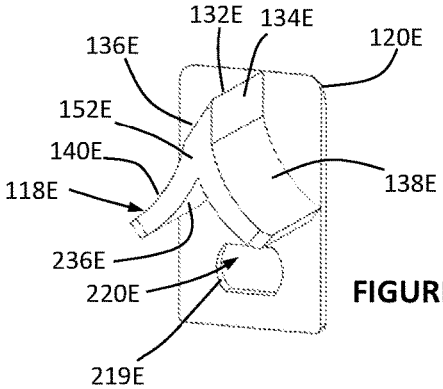
FIG. 20 depicts a perspective view of a blade portion of the wood splitter of FIG. 19 for mounting within a hitch receiver of a vehicle.

FIG. 19-20 illustrates another embodiment of the article of invention equipped with both a primary blade 118E and a secondary blade 120E aligned generally perpendicular to each other. The secondary blade option provides for the creation of an additional wood piece during each wood splitting cycle. In this embodiment, body portion 128E is in the form of a generally square elongate tube although the illustrated embodiment and other embodiments may alternatively use a solid elongate bar, U-channel, L-shape, or other shape configuration. When using non-bar materials, wall thicknesses should be sufficient to prevent plastic deformation upon splitting impact. In this embodiment, body portion 128E serves as both a fixation portion 104E and as a support of blade portion 102E. In this embodiment, primary blade 118E comprises opposed primary deflector face 138E and secondary deflector face 140E to wedge the wood apart during splitting. Superiorly, the deflector faces narrow and transition into primary edge face 134E and secondary edge face 136E until reaching cut edge 132E. Inferiorly, blade bottom blade surface 236E rests over top face 154E of body portion 128E and is secured in place with welds therebetween. An optional secondary blade 120E is joined, preferably by welding, to a proximal end face of body portion 128E and primary blade 118E. In some embodiments as illustrated here, a bottle opener recess 220E defined by an opener face 219E is provided for the user to open and consume bottled drinks when splitting wood. In this embodiment, bottle open recess 220E is positioned for opening to the internal tube cavity 129E of body portion 128E. Although most embodiments illustrate the cut edge of a primary blade or secondary blade to be generally linear, in alternative embodiments, the cut edge may be concave or convex superiorly.

Figure 21:
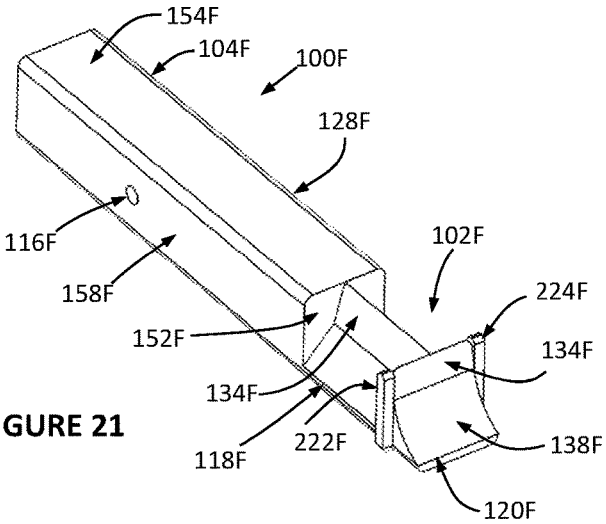
FIG. 21 depicts a top perspective view of a wood splitter for mounting within a hitch receiver of a vehicle.

FIG. 21 illustrates another embodiment of the article of invention. In this embodiment, wood splitter 100F comprises a solid body portion 128F. Here primary blade 118F and optional secondary blade 120F are machined or casted. As illustrated in this embodiment, a blunt sided first bumper 222F and a second bumper 224F may be secured to the side edges of blades to reduce blade exposure. The bumper is sometimes referred herein as a log boss.

Figure 22:
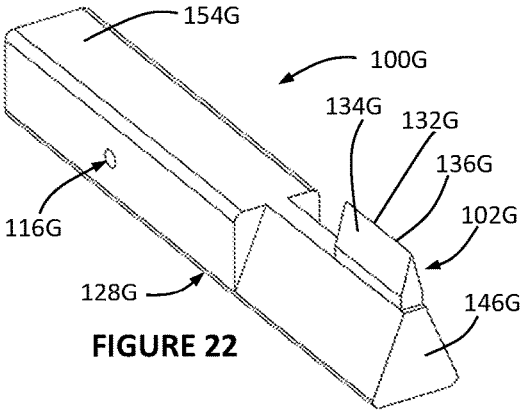
FIG. 22 depicts a top perspective view of a wood splitter having a removable portion of a blade portion for mounting within a hitch receiver of a vehicle.
Figure 23:
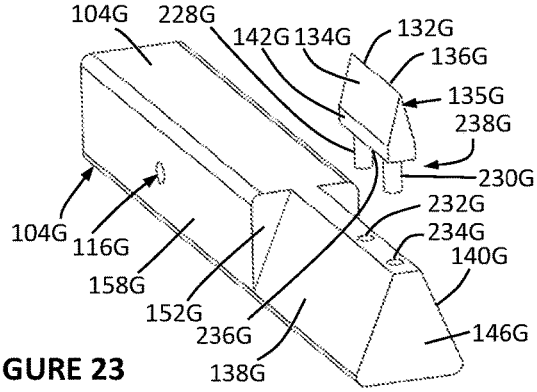
FIG. 23 depicts a top perspective exploded view of the wood splitter of FIG. 22 having a removable portion of a blade portion for mounting within a hitch receiver of a vehicle.

FIG. 22-23 illustrates another embodiment of a wood splitter 100G comprising a body portion 128G that is solid and having a blade portion 102G that is at least partially removable. Sloped primary deflector face 138G and secondary deflector face 140G are cut in body portion 128G. A blade interlock 238G mechanism is used to secure a removable edge portion 135G of the blade from blade portion 102G. In this embodiment blade interlock 238G is in the form of a pair of spaced tongues namely first tongue 228G and second tongue 230G extending from blade bottom surface 236G. The first tongue 228G and second tongue 230G are received a complementary first recess 232G and second recess 234G in an operational configuration and the removable aspect may be separated from the blade portion in a storage configuration as illustrated in FIG. 23. Alternatively, the recesses and tongues may be reversed such that the tongues extend from body portion 128G.

Figure 24:
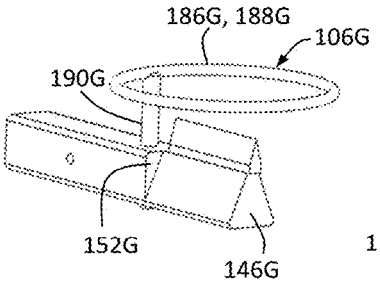
FIG. 24 depicts a top perspective view of the wood splitter of FIG. 22 including a guard portion for mounting within a hitch receiver of a vehicle.
Figure 25:
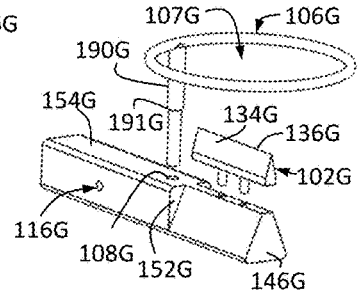
FIG. 25 depicts a top perspective exploded view of the wood splitter of FIG. 22 including a guard portion for mounting within a hitch receiver of a vehicle.
Figure 26:
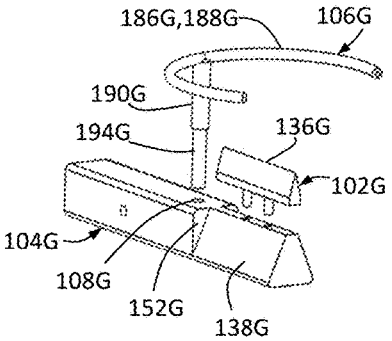
FIG. 26 depicts a top perspective view of the wood splitter of FIG. 22 including an alternative guard portion for mounting within a hitch receiver of a vehicle.

FIG. 24-25 illustrates an embodiment of the wood splitter of FIG. 22 with a guide portion 106G. In this embodiment, guide portion 106G comprises guide wall 186G with guide surface 188G thereon wherein the guide wall is in the form of a generally horizontally ring, however may form other shapes such as an oval or square in other embodiments. Guide wall 186G is supported by at least one first guide leg 190G and generally centered superiorly (but may be offset) over blade portion 102G. First guide leg 190G is received in first guide receiver 108G to support it in position. A leg stop 191G may be used to properly position the guide legs. Examples of leg stops may include lock pins as described earlier, bosses, spring clips, leg diameter changes (as illustrated here). FIG. 26 illustrates an alternative shaped guide wall 186G that is opened at one end for user convenience. In alternative embodiments, portions of the guide wall 186G may be linear as discussed earlier and cut edges 132G of blade portion 102G may be offset from center as illustrated elsewhere in this disclosure. In embodiments wherein the guide wall is ring shaped, it consequently defines a guide aperture 107G through which the user feeds wood to be split.

Figure 27:
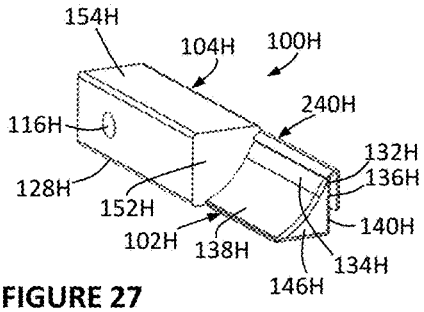
FIG. 27 depicts a top perspective view of a wood splitter including a blade cover for mounting within a hitch receiver of a vehicle.
Figure 28:
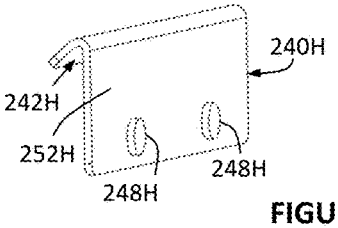
FIG. 28 depicts two side views of the blade cover illustrated in FIG. 27.

FIGS. 27 and 28 illustrate an embodiment of a blade cover 240H for use during a storage configuration (mode) to minimize exposure to a blade portion 102H when not in use. In this embodiment, blade cover 240H comprises a primary cover wall 244H and a secondary cover wall 246H intersecting to form an edge pocket 242H of size and shape to enclose a cut edge 132H. Primary cover wall 244H and secondary cover wall 246H are preferably shaped to generally parallel any one or more corresponding edge faces, deflector faces, and transition faces of blade portion 102H. In one embodiment, blade cover 240H comprises one or more magnets 248H secured to secondary cover wall 246H on inner cover surface 250H and on external cover surface 252H. Magnets 248H on inner cover surface 250H, releasably secure the cover over cut edge 132H by magnetic attraction with blade portion 102H. Magnets 248H on external cover surface 252H, secure blade cover 240H to a part of body portion 128H such as bottom face 156H to prevent loss when wood splitter 100H is used in operational mode. However, inner cover magnets may be used in both a storage and operational mode.

Figure 29:
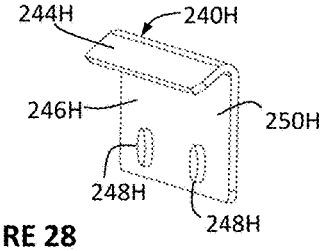
FIG. 29 depicts a top perspective view of a wood splitter including a blade cover positioned over a kindling collector.
Figure 29:
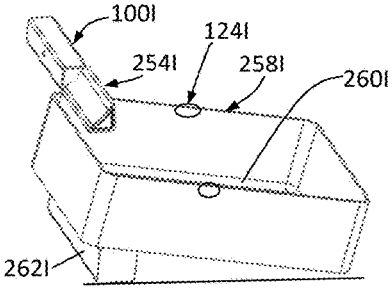
Figure 30:
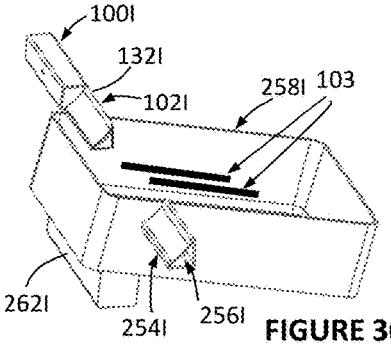
FIG. 30 depicts a top perspective view of a wood splitter with a blade cover removed and positioned over a kindling collector.

FIGS. 29 and 30 illustrate an embodiment of a wood splitter 100I as it would be if secured in a hitch receiver of a vehicle 127 with a collector 258I positioned between wood splitter 100I and a ground surface. As wood is driven downward over a cut edge 132I, wood pieces such as kindling 103 are split off and fall into collector 258I. Collector 258I is in the form of a bucket or tub in some embodiments and may comprise a collector handle 124I such as a bucket handle for carrying convenience. As noted in FIG. 30, sleeve 254I is preferably sized and shaped with sleeve cavity 256I to complement the size and shape of blade portion 102I and be slid off in an operational configuration and slid over blade portion 102I in a storage configuration. Collector 258I may be inclined such that split wood pieces fall away from blade portion 102I and collect on collector floor 260I. An elevator 262I such as a wood block or brick may be used to provide inclination to encourage kindling to fall in a somewhat orderly pile.

Figure 31:
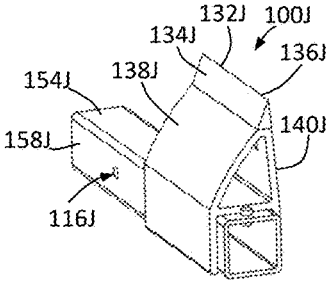
FIG. 31 depicts a top perspective view of a wood splitter having a removeable blade portion and an extruded deflector body portion.
Figure 32:
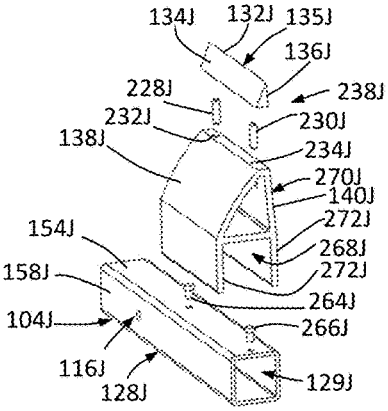
FIG. 32 depicts a top perspective exploded view of the wood splitter of FIG. 31.
Figure 33:
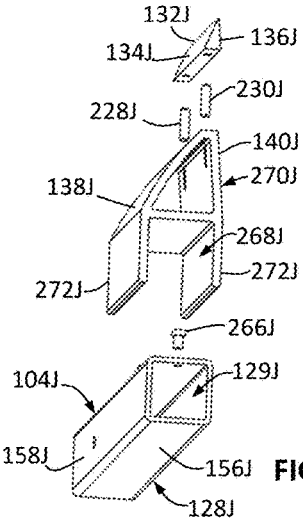
FIG. 33 depicts a bottom perspective exploded view of the wood splitter of FIG. 31.

FIG. 31-33 illustrates another embodiment of a wood splitter 100J comprising a deflector saddle 270J portion. The deflector saddle 270J in this embodiment is extruded preferably of an aluminum alloy with primary deflector face 138J and secondary deflector face 140J integrated into the body of the extrusion. The deflector saddle 270J portion is configured for fixed or removable mounting on top face 154J of body portion 128J. In a fixed configuration, fasteners or equivalents may be used. In a removable configuration, deflector saddle 270J may include a pair of opposing saddle legs 272J defining a U-channel 268J sized to slide over and seat on body portion 128J. A first positioner 264J and a second positioner 266J are positioned on and protrude from top face 154J to position deflector saddle 270J portion therebetween. Also illustrated is a blade interlock 238J operating as described with previous embodiments.

Figure 34:
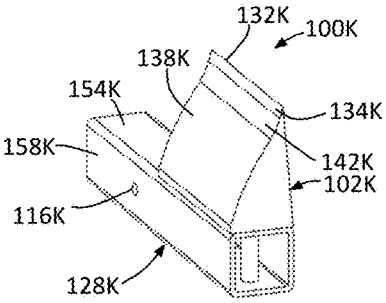
FIG. 34 depicts a top perspective view of a wood splitter having a removeable blade portion.
Figure 35:
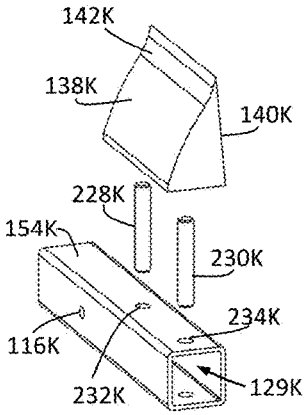
FIG. 35 depicts a top perspective exploded view of the wood splitter of FIG. 34.
Figure 36:
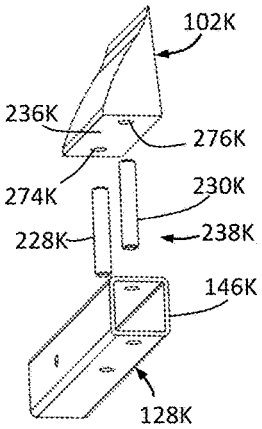
FIG. 36 depicts a bottom perspective exploded view of the wood splitter of FIG. 34.

FIGS. 34-36 illustrates yet another embodiment of a wood splitter 100K comprising a blade portion 102K fixed or removably fixed to top face 154K of body portion 128K. Body portion 128K may be solid or tubular. First tongue 228K and second tongue 230K are pressed, threaded or otherwise fixed in respective first blade port 274K and second blade port 276K which are disposed in blade bottom surface 236K. First and second tongue 228K, 230K are housed in respective first recess 232K and second recess 234K which extend into top face 154K of body portion 128K. In other forms first tongue 228K and second tongue 230K are in the form of bolts for fastening blade portion 102K to top face 154K. In some forms blade portion 102K is welded to body portion 128K.

Figure 37:
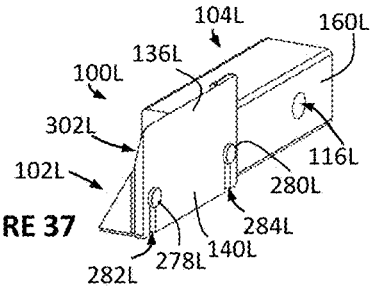
FIG. 37 depicts a top perspective view of a wood splitter having a removeable blade portion.
Figure 38:
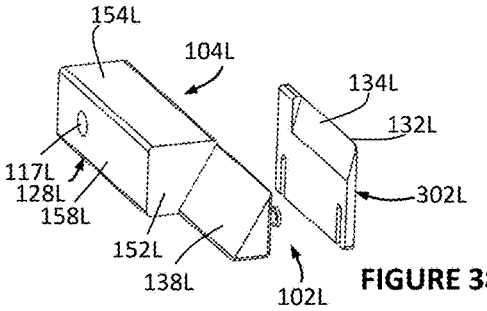
FIG. 38 depicts a top perspective exploded view of the wood splitter of FIG. 37.
Figure 39:
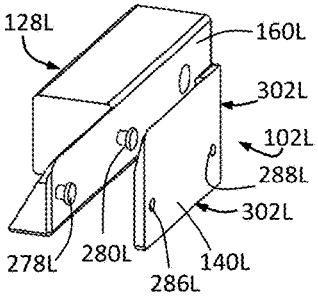
FIG. 39 depicts a top perspective exploded view of the wood splitter of FIG. 37.

FIG. 37-39 illustrates another embodiment of a wood splitter 100L comprising a removable blade plate 302L. Here, a part of blade portion 102L is in the form of a blade plate 302L having a cut edge 132L at a superior end and at least one of a primary and a secondary edge face 134L, 136L. Extending from an inferior end of the plate is a generally vertical first blade slot 282L and a distally spaced second blade slot 284L. A complementing first blade post 278L and a second blade post 280L having heads are positioned for securing the removable blade plate 302L adjacent second side face 160L. Primary deflector face 138L is sloped to meet removable blade plate 302L. As yet another variation, removable blade plate 302L comprises a first blade hole 286L and a second blade hole 288L extending through removable blade plate 302L. In this embodiment, first blade post 278L and second blade post 280L are in the form of screw fasteners for threadably locking the plate to body portion 128L.

Figure 40A:
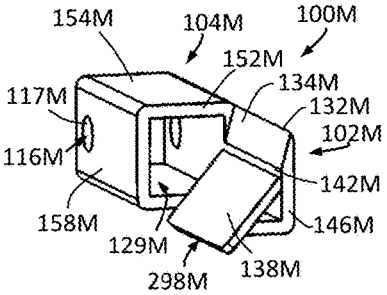
FIG. 40A depicts a top perspective view of a wood splitter having an integrated blade portion.
Figure 40B:
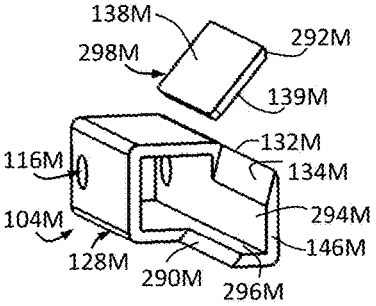
FIG. 40B depicts a top perspective exploded view of the wood splitter of FIG. 40A having an integrated blade portion.
Figure 45:
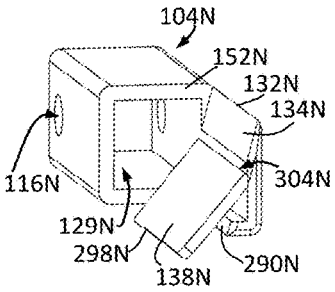
FIG. 45 depicts a top perspective view of a wood splitter configured for mounting within a hitch receiver of a vehicle.
Figure 46:
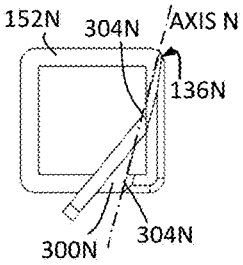
FIG. 46 depicts an end view of the wood splitter of FIG. 45 with integrated blade portion and configured for mounting within a hitch receiver of a vehicle.

FIG. 40A, 40B illustrate an embodiment of a wood splitter 100M comprising a cut edge 132M integrated into an upright wall 294M of tubular body portion 128M. A base wall 296M extends horizontally from the bottom of upright wall 294M. Sloped at the end of base wall 296M is deflector support face 290M for support of sub-primary deflector face 139M of deflector plate 298M. Deflector mate face 292M abuts an inside surface of upright wall 294M. A weld may be used at contact junctions between deflector plate 298L and one or more of upright wall 294M and deflector support face 290M. Note that primary edge face 134M is sloped steeper than primary deflector face 138M in preferred embodiments. Similarly, FIGS. 45-48A illustrate various embodiments with deflector plate mounting variations. In these embodiments, primary edge face 134N, 134P are aligned with respective deflector support face 290N, 290P for simplified manufacturing purposes. FIG. 45, 46 illustrate use of a support wedge 300N to provide support to deflector plate 298N, whereas in the embodiment in FIG. 47, 48A a sub-primary deflector face 139P is supported at an upper edge of deflector support face 290P. Contact junctions between the deflector plate and a base wall and an upper wall are preferably welded 304N. Welds 304N also hold support wedge 300N in place.

Figure 41A:
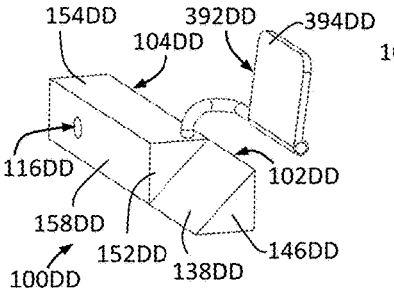
FIG. 41A depicts a top perspective view of a wood splitter having a pivotable blade guide and cover.
Figure 41B:
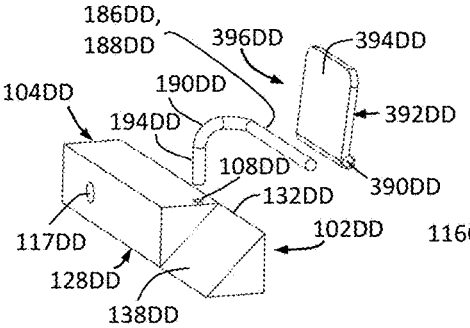
FIG. 41B depicts a top perspective exploded view of the wood splitter of FIG. 41A.

FIGS. 41A-41B illustrate an embodiment of a wood splitter 100AI configured with a foldable guide 396AI that functions as a blade cover in a storage configuration. In this embodiment, first guide receiver 108AI extends into body portion 128AI through top face 154AI. First guide foot 194AI at the terminal end of first guide leg 190AI is housed in first guide receiver 108AI. Guide wall 186AI with guide surface 188AI thereon runs generally parallel, superior, and along the length of cut edge 132AI. Pivot plate 392AI comprises a pivot cylinder 390AI extending along an inferior edge of pivot plate 392AI allowing consequent movement between it and guide wall 186AI. Pivot motion of pivot cylinder is limited to approximately 90 degrees between an operational and storage configuration. In an operational configuration, shield face 394AI is generally upright to serve as a guide to log 101 pieces to be split. In a storage configuration, pivot plate 392AI is folded down covering cut edge 132AI.

Figure 42:
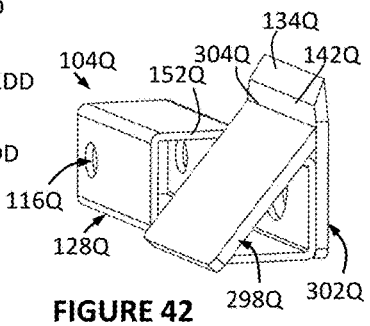
FIG. 42 depicts a top perspective view of a wood splitter having a side mounted blade portion configured for mounting within a hitch receiver of a vehicle.
Figure 43:
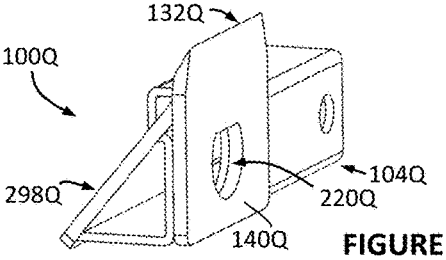
FIG. 43 depicts a top perspective view of the wood splitter of FIG. 42 for mounting within a hitch receiver of a vehicle.
Figure 44:
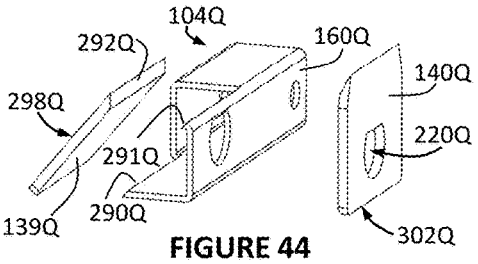
FIG. 44 depicts an exploded top perspective view of the wood splitter of FIG. 42 configured for mounting within a hitch receiver of a vehicle.

FIGS. 42-44 illustrate an embodiment of a wood splitter 100Q having a deflector plate 298Q supported at upper deflector support face 291Q and deflector support face 290Q. Blade plate 302Q is secured to second side face 160Q and deflector mate face 292Q abuts primary transition face 142Q. Blade plate 302Q includes in this embodiment a bottle opener recess 220Q. Again, welds 304Q are preferably utilized to secure deflector plate 298Q to body portion 128Q and to blade plate 302Q. Likewise, welds are preferably utilized to secure blade plate 302Q to second side face 160Q.

Figure 47:
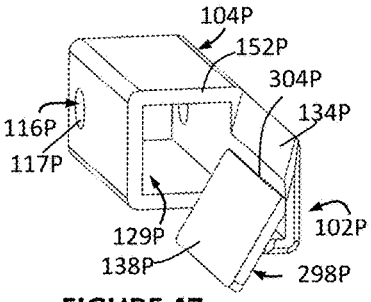
FIG. 47 depicts a top perspective view of a wood splitter with integrated blade portion for mounting within a hitch receiver of a vehicle.
Figure 48A:
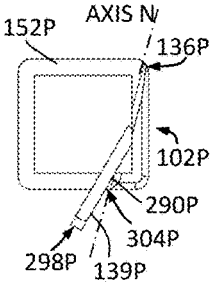
FIG. 48A depicts an end view of the wood splitter of FIG. 47 configured for mounting within a hitch receiver of a vehicle.
Figure 48B:
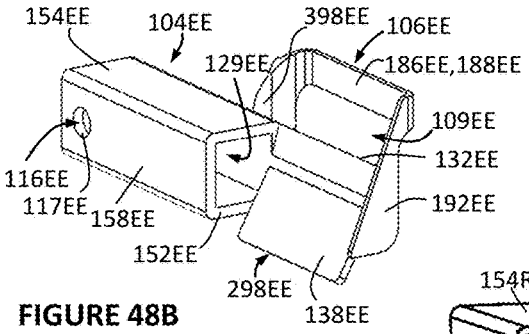
FIG. 48B depicts an end view of the wood splitter of FIG. 47 with guide configured for mounting within a hitch receiver of a vehicle.
Figure 48C:
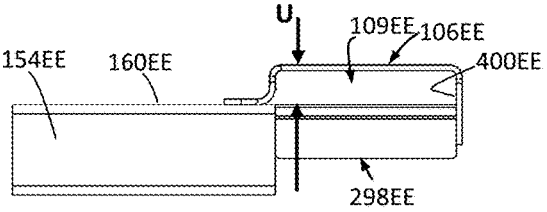
FIG. 48C depicts a top view of the wood splitter of FIG. 47 with guide configured for mounting within a hitch receiver of a vehicle.
Figure 48D:
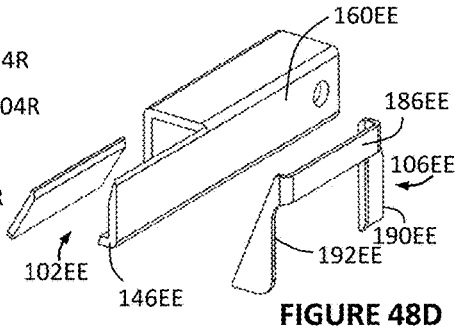
FIG. 48D depicts an exploded view of the wood splitter of FIG. 47 with guide configured for mounting within a hitch receiver of a vehicle.

FIGS. 48B, 48C, and 48D illustrate the wood splitter of FIG. 47 with one embodiment of a guide portion 106EE. In this embodiment, guide portion 106EE is generally U-shaped comprising a generally flat guide wall 186EE with guide surface 188EE formed thereon positioned substantially parallel and superior yet offset (by distance 'U') from cut edge 132EE. This arrangement defines a fall aperture 109EE through which split wood pieces will fall during splitting operations. Extending inferiorly at a distal end of guide wall 186EE is first guide leg 190EE with first fixation face 398EE thereon. Extending inferiorly at a proximal end of guide wall 186EE is second guide leg 192EE with second fixation face 400EE formed thereon. First fixation face 398EE is secured to second side face 160EE and second fixation face 400EE is secured to proximal end face 146EE. In preferred embodiments this fixation is by use of fasteners for the purpose of guide portion 106EE removal for blade sharpening otherwise welds and other similar mechanical operations may be used.

Figure 49:
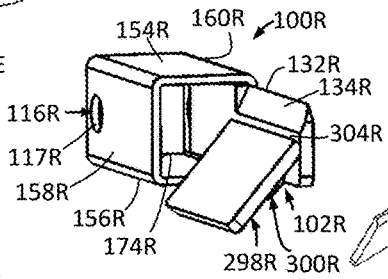
FIG. 49 depicts a top perspective view of a wood splitter having a flat blade portion for mounting within a hitch receiver of a vehicle.
Figure 50:
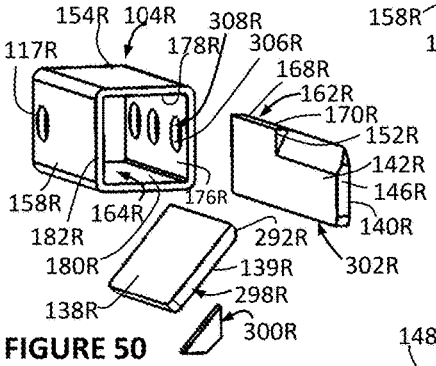
FIG. 50 depicts an exploded view of the wood splitter illustrated in FIG. 49.

FIG. 49-50 illustrates another embodiment of a wood splitter 100R comprising a joined tubular fixation portion 104R and a blade plate 302R. In this embodiment, blade plate 302R comprises a blade extension 162R for fixation against at least one of the internal tube faces within fixation recess 164R (alternatively, blade extension 162R may be fixed against an external tube face such as first side face 158R or second side face 160R). In this embodiment, blade extension 162R is fixed against second side recess wall 176R within fixation recess 164R. Fixation aperture wall 306R defines one or more fixation apertures 308R which may be used to weld blade plate 302R second side recess wall 176R. Alternatively, fasteners may be used to secure blade plate 302R to second side recess wall 176R. As a further alternative, blade plate 302R may be welded from inside fixation recess 164R to one of the adjacent internal walls. Deflector plate 298R is secured at a sloped angle to blade plate 302R by abutting deflector mate face 292R to primary transition face 142R and welding, fastening, or utilization of other fixation technique. Support wedge 300R may be used to provide additional support to deflector plate 298R.

Figure 51:
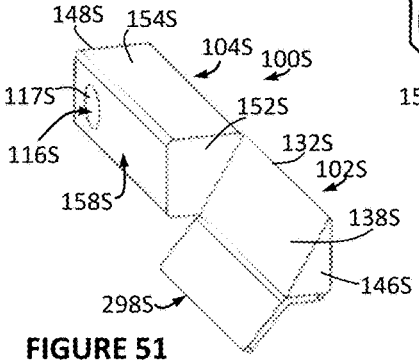
FIG. 51 depicts a top perspective view of a wood splitter configured for mounting within a hitch receiver of a vehicle.
Figure 52:
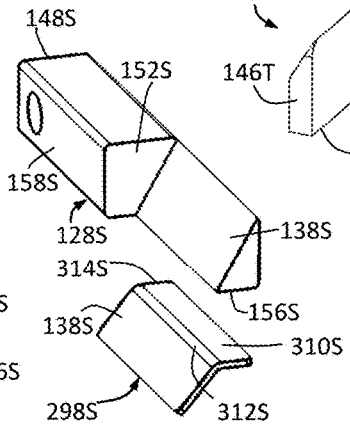
FIG. 52 depicts an exploded top perspective view of the wood splitter of FIG. 51 configured for mounting within a hitch receiver of a vehicle.

FIG. 51-52 illustrates yet another embodiment of a wood splitter 100S comprising a bottom face 156S mounted deflector plate 298S. Deflector plate 298S comprises a first flange 314S having upward facing landing face 310S which is configured for fixation to a downward facing face such as bottom face 156S of body portion 128S. Landing face 310S is fixed to bottom face 156S using common fixation methods such as fasteners or welds. Deflector plate 298S may comprise a deflector bend 312S for angulation purposes, however in alternative embodiments, deflector plate 298S is flat and bottom face 156S is angled in blade portion 102S to achieve the desired angulation.

Figure 53:
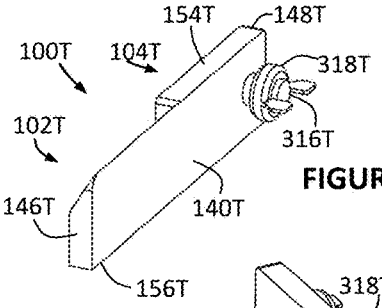
FIG. 53 depicts a top perspective view of a wood splitter configured for mounting within a hitch receiver of a vehicle.
Figure 54:
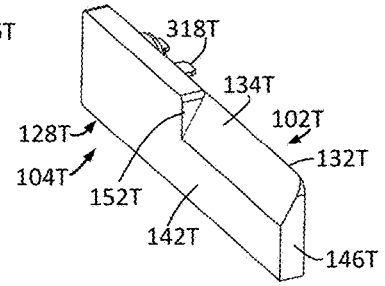
FIG. 54 depicts a top perspective view of the wood splitter of FIG. 53 configured for mounting within a hitch receiver of a vehicle.
Figure 55:
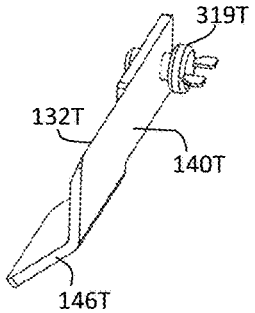
FIG. 55 depicts a top perspective view of a wood splitter with deflector portion for mounting within a hitch receiver of a vehicle.
Figure 56:
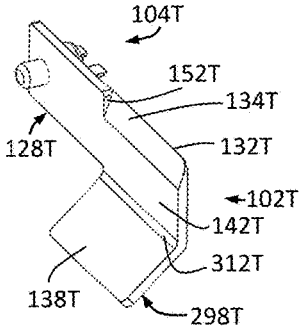
FIG. 56 depicts a top perspective view of the wood splitter with deflector portion of FIG. 55 configured for mounting within a hitch receiver of a vehicle.
Figure 57:
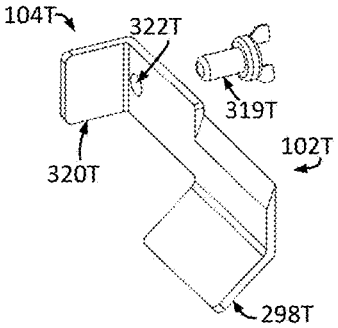
FIG. 57 depicts a top perspective view of a wood splitter illustrating an alternative fixation portion and configured for mounting within a hitch receiver of a vehicle.
Figure 58:
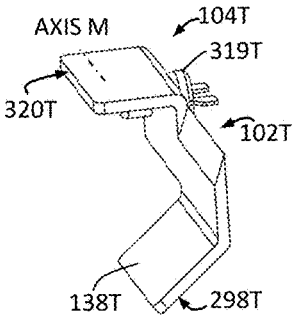
FIG. 58 depicts a top perspective view of a wood splitter illustrating an alternative fixation portion and configured for mounting within a hitch receiver of a vehicle.
Figure 59:
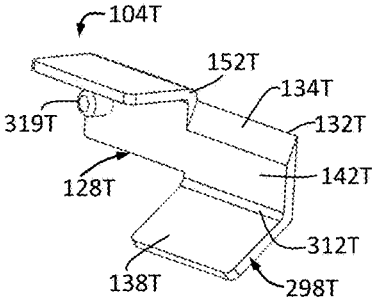
FIG. 59 depicts a top perspective view of the wood splitter of FIG. 58 illustrating an alternative fixation portion and configured for mounting within a hitch receiver of a vehicle.

The fixation portion of the article of invention has been primarily illustrated as a square tube or bar. The applicant recognizes the fixation portion may assume a variety of other shape profiles provided the shape profiles will typically reside in a common hitch receiver (typically 2"×2" or 1.25"×1.25" square, however it is recognized the invention will also perform in custom sized applications) and serve to support and fix blade portion position. For example, the fixation portion could assume a H, I, Z, +, X, T, L, and U shape profile preferably along axis-M to name just a few alternative profiles. FIGS. 53-59 illustrate just some example embodiments comprising alternative fixation portions. FIGS. 53 and 54 illustrate for example, a fixation portion 104T that is in the form of a flat bar. In this embodiment, body portion 128T which comprises both a fixation portion 104T and a blade portion 102T, comprises a cut edge 132T and a primary edge face 134T extending downward from the cut edge. In this embodiment, a clamp post 316T in combination with a tightened clamp nut 318T are utilized to releasably fix and support wood splitter 100T to a vertical wall within a hitch receiver. Alternatively, the clamp post and nut are in the form of a clamp bolt 319T threaded into threaded hole 322T of body portion 128T as illustrated in FIGS. 55-59. This embodiment (FIG. 53-54) does not include a sloped deflector face although it is recognized a deflector face could be readily integrated to the device using disclosure from embodiments disclosed earlier. In the embodiment of FIG. 55-56, a deflector plate 298T is formed as an extension of body portion 128T by formation of a deflector bend 312T thereby causing a formation of a sloped primary deflector face 138T. FIGS. 58-59 illustrate the embodiment of FIG. 55 adapted with a generally horizontal profile extension 320T from body portion 128T to form an L-shape fixation portion 104T along axis-M thereby adding additional torsional stability to the construct. The embodiment illustrated in FIG. 57 utilizes an upstanding profile extension 320T from body portion 128T to gain additional stability from the walls of a hitch receiver.

Figure 60:
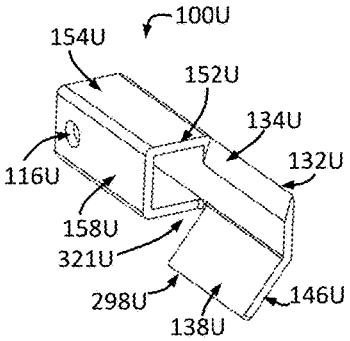
FIG. 60 depicts a top perspective view of a wood splitter with integrated blade and deflector portions and configured for mounting within a hitch receiver of a vehicle.
Figure 61:
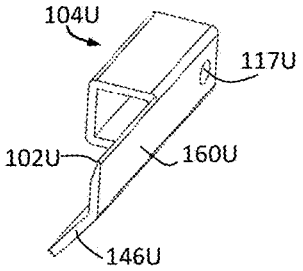
FIG. 61 depicts an alternative top perspective view of the wood splitter of FIG. 60 with integrated blade and deflector portions and configured for mounting within a hitch receiver of a vehicle.
Figure 62:
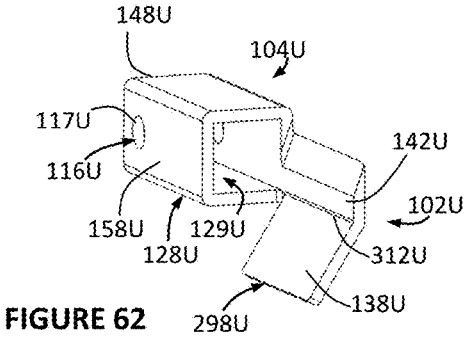
FIG. 62 depicts a top perspective view of a wood splitter with lowered integrated blade and deflector portions and configured for mounting within a hitch receiver of a vehicle.

FIGS. 60 and 61 illustrate another embodiment of a wood splitter 100U comprising a blade portion 102U including deflector plate 298U that are formed from body portion 128U. In this embodiment, a portion of tubular body portion 128U is cut away, a deflection cut 321U is made, and a bottom wall of the tubular body is bent downwards at deflector bend 312U thereby forming angled deflector plate 298U.

Figure 63:
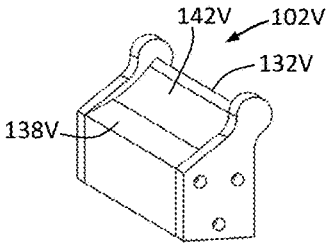
FIG. 63 depicts a top perspective view of a wood splitter blade portion equipped with side bosses (log bosses)
Figure 64:
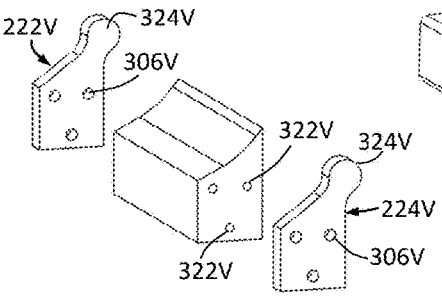
FIG. 64 depicts an exploded top perspective view of the wood splitter blade of FIG. 63 with side bosses.

FIG. 63 illustrates an embodiment of a blade portion 102V comprising a first bumper 222V and a second bumper 224V situated on each end of the blade portion 102V to buffer interaction between users and cut edge 132V. First and second bumper 222V, 224V preferably comprise an enlarged portion 324V nearest a cut edge 132V. In this embodiment, the enlarged portion 324V is in the form of a bulb. Fixation apertures 306V may be included for use of fasteners in threaded holes 322V to secure to blade portion 102V.

Figure 65:
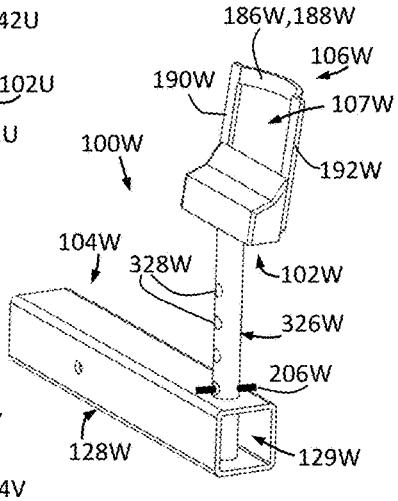
FIG. 65 depicts a top perspective view of an adjustable height wood splitter and configured for mounting within a hitch receiver of a vehicle.
Figure 66:
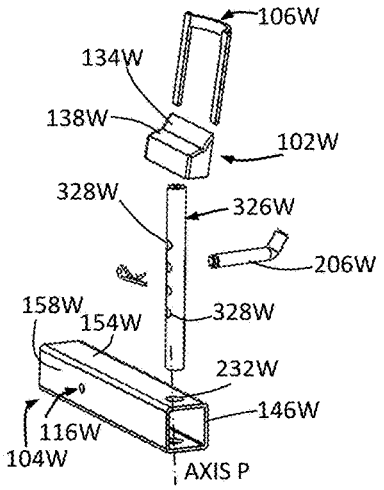
FIG. 66 depicts an exploded top perspective view of the wood splitter of FIG. 65 configured for mounting within a hitch receiver of a vehicle.
Figure 67:
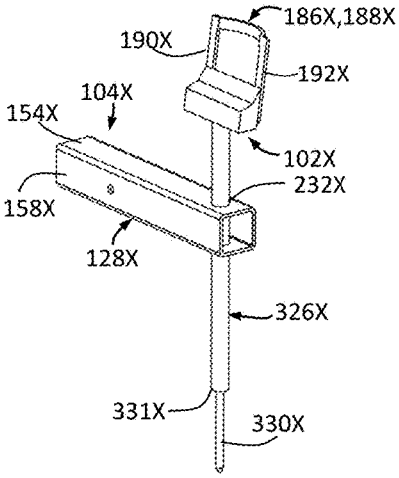
FIG. 67 depicts a top perspective view of a ground engaging wood splitter configured for mounting within a hitch receiver of a vehicle.
Figure 68:
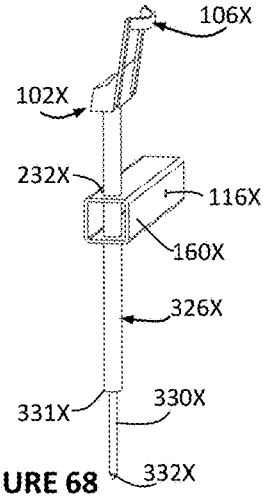
FIG. 68 depicts an alternative top perspective view of the ground engaging wood splitter of FIG. 67 configured for mounting within a hitch receiver of a vehicle.
Figure 69:
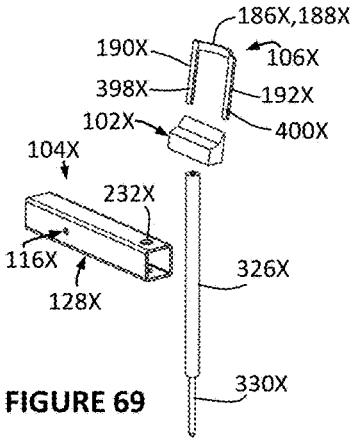
FIG. 69 depicts an exploded top perspective view of the ground engaging wood splitter of FIG. 67 configured for mounting within a hitch receiver of a vehicle.
Figure 70:
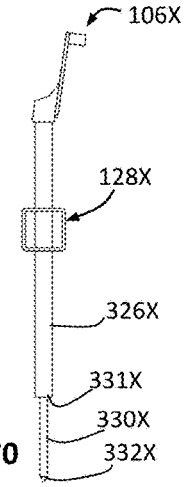
FIG. 70 depicts an end view of the ground engaging wood splitter of FIG. 67 configured for mounting within a hitch receiver of a vehicle.

FIGS. 65 and 66 illustrate another embodiment of a wood splitter 100W comprising an adjustable height blade portion 102W for improved user ergonomics. In this embodiment, blade portion 102W is secured to the superior end of a height strut 326W by use of threaded, pinned, welded or other suitable technique. In this embodiment, height strut 326W stands generally vertical and is removably housed within first recess 232W along axis P. Height strut 326W comprises a plurality of spaced height apertures 328W along the length of height strut 326W. Height apertures 328W are configured to house a removable first lock pin 206W for height adjustment of blade portion 102W by the user. First lock pin 206W secures blade portion 102W at a chosen height by abutting against top face 154W of body portion 128W. When the user is done using the wood splitter 100W, first lock pin 206W may be removed as well as blade portion 102W with height strut 326W and guard 106W. FIG. 67-70 illustrate an embodiment similar to that illustrated in FIGS. 65 and 66 but without a height adjustment feature. In this embodiment, an inferior end of height strut 326X comprises a ground stake 330X. Ground stake 330X preferably has a narrowed entry point 332X for eased insertion into dirt. Ground pad 331X is a broadened surface for abutting a ground surface to maintain a definitive blade portion 102X height and also add stability to the construct. In an alternative embodiment, ground stake 330X is absent wherein ground pad 331X provides the sole stability. In this case, ground pad 331X may include a bevel, point or other ground engaging surface.

Figure 71:
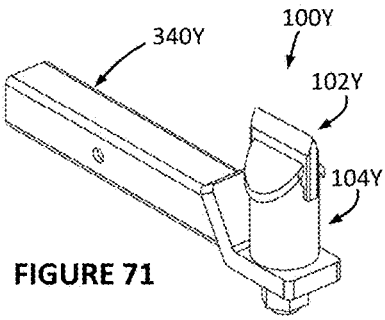
FIG. 71 depicts a top perspective view of a hitch ball mounted wood splitter configured for use over a hitch ball.
Figure 72:
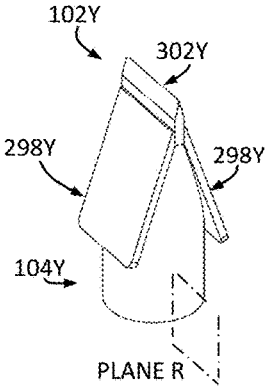
FIG. 72 depicts a top perspective view of a hitch ball wood splitter configured for use over a hitch ball.
Figure 72B:
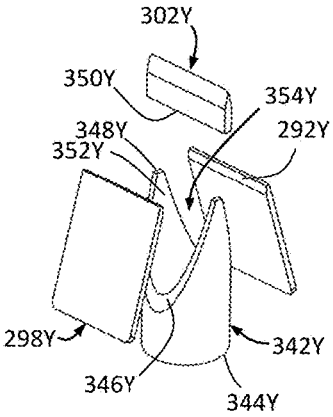
FIG. 72B depicts an exploded view of the hitch ball wood splitter of FIG. 72.
Figure 73:
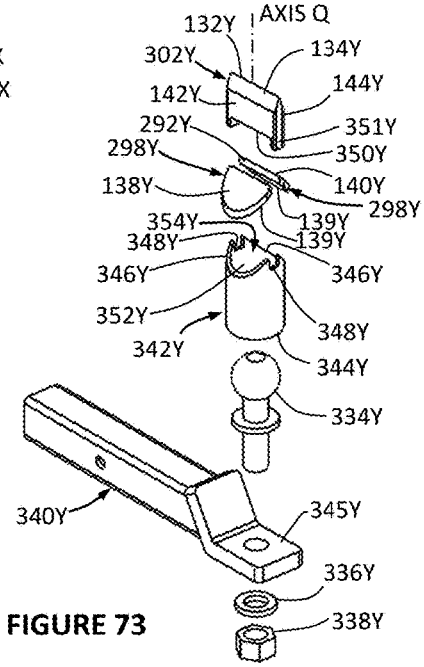
FIG. 73 depicts an exploded top perspective view of a hitch ball mounted wood splitter configured for use over a hitch ball.

FIGS. 71 and 73 illustrates another embodiment of a wood splitter 100Y configured for capture over a hitch ball 334Y. In this embodiment a user uses a standard ball mount 340Y with hitch ball 334Y secured to it using a hitch ball washer 336Y and a hitch ball nut 338Y to secure the construct. Standard ball mounts are available in a variety of forms with various levels of drop or elevation. The ball mount illustrated in FIG. 71 for example, provides a 2 inch drop or if turned 180 degrees a zero inch drop. Users may choose elevation or drop levels best suited for the application. Some may prefer for example, elevated ball mounts for improved biomechanics (i.e. reduced back bending). A wood splitter 100Y in this embodiment comprises a blade portion 102Y and fixation portion 104Y with ball space 354Y located therein for mounting on ball mount 340Y and hitch ball 334Y. Fixation portion 104Y comprises a blade housing 342Y preferably in the form of a cylindrical tube although other profiles such as a square tube may be used. Blade housing 342Y comprises a base surface 344Y at an inferior end and a pair of opposed perch surfaces 348Y at a superior end. Sloping downward and away from perch surfaces 348Y are opposed slope surfaces 346Y on each side of vertical plane R beginning near a superior end of said blade housing 342Y. A blade plate 302Y comprises a rest surface 350Y at an inferior end and a cut edge 132Y at a superior end, and opposed primary transition face 142Y and secondary transition face 144Y defining the sides. A pair of opposed deflector plates 298Y comprise an upward facing primary deflector face 138Y on one plate and an upward facing secondary deflector face 140Y on the other. Each deflector plate 298Y comprises a sub-primary deflector face 139Y on an inferior surface. Each deflector plate 298Y is secured to blade housing 342Y preferably by welds between slope surface 346Y and the corresponding sub-primary deflector face 139Y. Blade plate 302Y may be removable or preferably secured by weld between rest surface 350Y and perch surfaces 348Y. Wood splitter 100Y is removed from hitch ball 334Y in a storage mode. To change to an operational mode, a ball mount 340Y with hitch ball 334Y is secured in a hitch receiver 126 of a vehicle and serves to support fixation portion 104Y. Wood splitter 100Y is then placed over hitch ball 334Y such that hitch ball 334Y is confined within ball space 354Y of fixation portion 104Y which is defined by internal capture face 352Y. Base surface 344Y is seated on and supported by an upward facing base pod 345Y of ball mount 340Y. In preferred embodiment the diameter of ball space 354Y is only slightly larger than hitch ball 334Y for added stability (i.e. <0.1", although it may be larger). In this embodiment, alignment of parts along axis Q is preferred as illustrated. FIGS. 72 and 72B illustrate a similar embodiment as FIG. 71-72 but with squared deflector plates 298Y at a steeper slope and notches at the perch surfaces are removed. Note that in some embodiments blade plate 302Y is removable and may be separated by the user for temporary safety purposes if so desired. One or more positioning boss 351Y may be used to capture and/or align the blade plate 302Y to blade housing 342Y.

Figure 74:
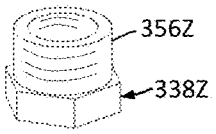
FIG. 74 depicts a top perspective view of a hitch ball nut mounted wood splitter configured for use over an opposing end of a hitch ball.
Figure 75:
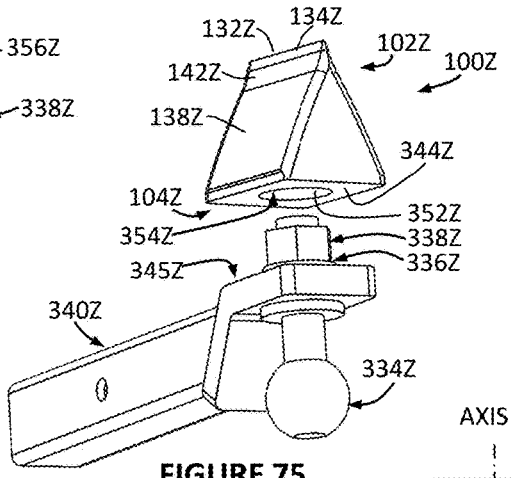
FIG. 75 depicts a modified hitch ball nut as used in the hitch mounted wood splitter of FIG. 74.
Figure 76:
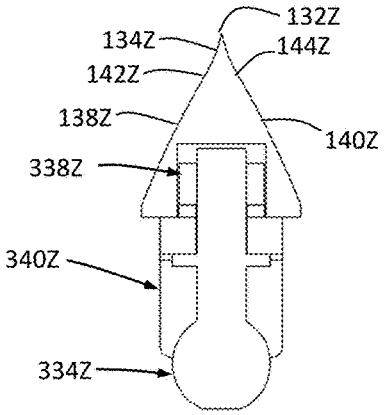
FIG. 76 depicts a cross sectional view through the hitch ball of the hitch ball nut mounted wood splitter of FIG. 74.
Figure 77:
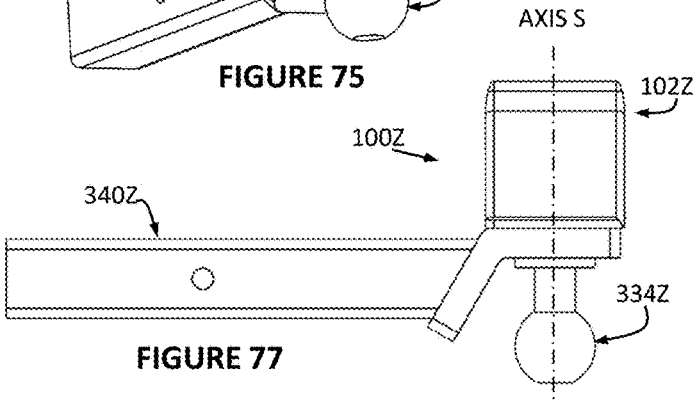
FIG. 77 depicts a side view of the hitch ball nut mounted wood splitter of FIG. 74.

FIGS. 74-77 illustrate another embodiment of a wood splitter 100Z configured for capture over the reverse side of a standard hitch ball 334Z secured in a ball mount 340Z. In this embodiment, blade portion 102Z is in the form of a wedge comprising a superiorly facing cut edge 132Z. The disclosed cut edges, they may range from sharpened to relatively dull depending on the performance desired by the user. Extending into a generally horizontal base surface 344Z is a ball space 354Z defined by capture face 352Z. Ball space 354Z is sufficient in size to slide only over hitch ball nut 338Z and hitch ball washer 336Z such that base surface 344Z abuts base pod 345Z on ball mount 340Z. In an alternative embodiment, ball space 354Z is threaded. In turn, a portion of the external surface of hitch ball nut 338Z comprises external threads 356Z for threaded engagement therebetween as illustrated in FIG. 74.

Wood splitter 100Z is removed from hitch ball mount 340Z in a storage configuration by lifting off or unthreading if threaded engagement. In an operational configuration, the user inserts hitch ball mount 340Z into a hitch receiver 126 of a vehicle 127 in an upside-down orientation. The user then places wood splitter 100Z with ball space 354Z over hitch ball nut 338Z and hitch ball washer 336Z. Wood splitter 100Z is then ready for use.

Figure 79:
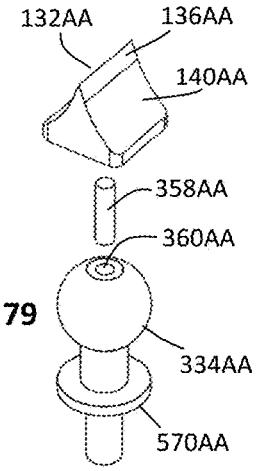
FIG. 79 depicts an exploded top perspective view of the hitch ball mounted wood splitter of FIG. 78.
Figure 78:
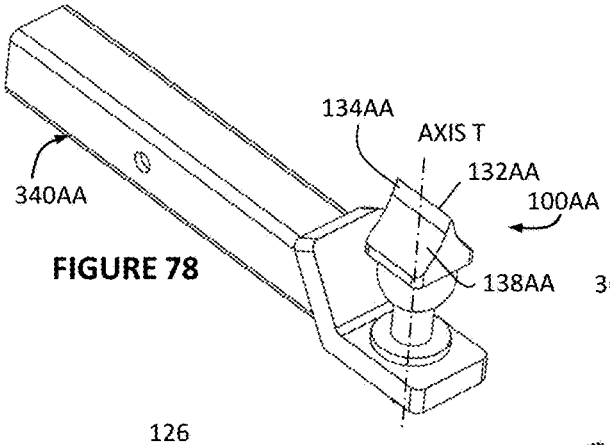
FIG. 78 depicts a top perspective view of a hitch ball mounted wood splitter for use on a hitch ball.
Figure 80:
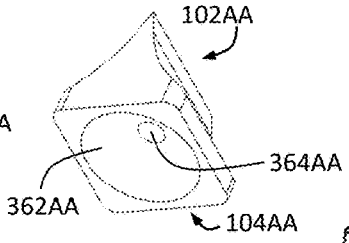
FIG. 80 depicts a blade and deflector portions of the hitch ball mounted wood splitter of FIG. 78.

FIG. 78-80 illustrate another embodiment of a wood splitter 100AA again utilizing a modified hitch ball 334AA and standard ball mount 340AA to mount a fixation portion 104AA on. In this embodiment, hitch ball 334AA comprises a rod capture 360AA typically in the form of a bore along axis T. Rod capture 360AA may extend entirely through to an opposing end of hitch ball 334AA for the passage of water if so desired or diverted to exit at a side of the ball. Blade rod 358AA may be in the form of one or more of a smooth pin, a threaded rod, or a combination of threads on one end and smooth on the other. Blade rod 358AA in this embodiment is mechanically pressed in rod recess 364AA yet left partially protruding from hemi-spherical ball palm 362AA surface. Rod capture 360AA in this embodiment is sized to allow sliding insertion of the protruding end of blade rod 358AA therein. In alternative embodiments, the exposed end of blade rod 358AA is threaded and is housed in complementary threads in rod capture 360AA. Wood splitter 100AA and blade rod 358AA are removed from hitch ball 334AA in a storage configuration. In an operational configuration, the user places wood splitter 100AA over hitch ball 334AA such that blade rod 358AA is housed within rod capture 360AA and ball palm 362AA abuts hitch ball 334AA. Blade rod 358AA holds wood splitter 100AA in position at the top of hitch ball 334AA.

Figure 82A:
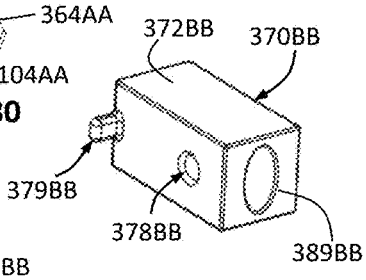
FIG. 82A depicts a top perspective view from a trailing end of the hitch coupler of FIG. 82.
Figure 81:
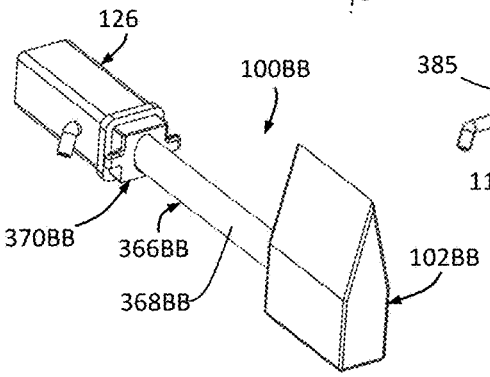
FIG. 81 depicts a top perspective view of an axe convertible to hitch wood splitter configured for mounting within a hitch receiver of a vehicle.
Figure 82:
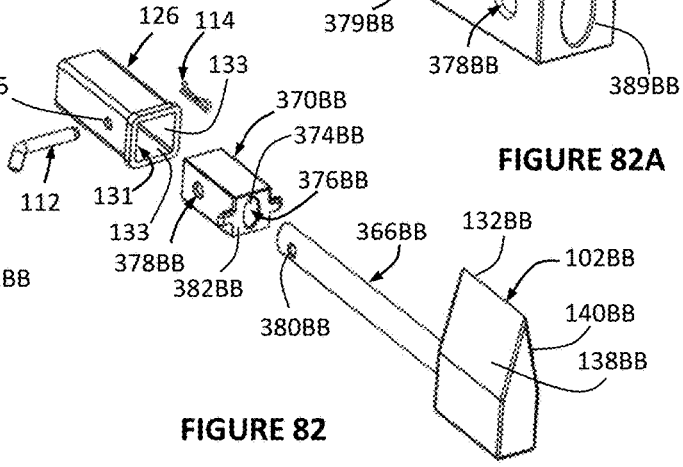
FIG. 82 depicts a top perspective view of an axe removed from a hitch coupler that is operable for mounting within a hitch receiver of a vehicle.

FIGS. 81,82,82A illustrate yet another embodiment of a wood splitter 100BB configured for use both as a hand axe and as a hitch receiver mounted wood splitter. In this embodiment, a blade portion 102BB is fixed to an elongate axe handle 366BB. An axe handle surface 368BB envelopes elongate axe handle 366BB. A retaining hole 380BB extends through axe handle 366BB at a distal end for locking in position with a hitch pin 112 if so desired. Hitch coupler 370BB comprises a generally square coupler outer surface 372BB (although other profiles are contemplated) sized for sliding fit into receiver cavity 131 defined by receiver surfaces 133 of a corresponding hitch receiver 126. A coupler hole 378BB extends through hitch coupler 370BB for occupation by a hitch pin 112 for securing both axe handle 366BB and hitch coupler 370BB within hitch receiver 126. Coupler inner face 374BB defines handle cavity 376BB. Handle cavity 376BB is sized and shaped to complement axe handle surface 368BB profile to prevent movement therebetween during operation. The complementing surfaces are preferably non-circular. Lead face 382BB and trailing face 389BB cap off ends of hitch coupler 370BB. To use as an axe or for storage mode configuration (FIG. 82), hitch pin 112 is removed if present and blade portion 102BB with axe handle 366BB are distracted from hitch coupler 370BB. In an operational configuration (FIG. 81), axe handle 366BB is slid into hitch coupler 370BB and the assembly is placed in a suitable sized hitch receiver of a vehicle. A hitch pin 112 may be used to lock the assembly in position. Hitch coupler 370BB preferably comprises one or more finger features for easy insertion and removal of the hitch coupler 370BB in receiver cavity 131 of hitch receiver 126. In this embodiment, the finger features are illustrated in the form of coupler ears 379BB extending from the sides of hitch coupler 370BB. In other embodiments the finger feature may be in the form of a depression or ridge. In alternative embodiments, hitch coupler 370BB may be partially or fully split for eased coupling around axe handle 366BB. In addition, coupler inner face 374BB and axe handle 366BB may include complementary intermeshing features such as teeth. In this embodiment, the axe serves as blade portion 102BB and hitch coupler 370BB serves as a fixation portion.

Figure 83:
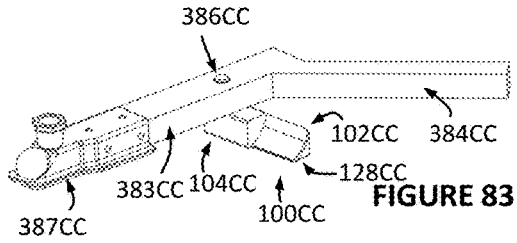
FIG. 83 depicts a top perspective view of a wood splitter secured to a frame of a trailer in an operational mode.
Figure 84:
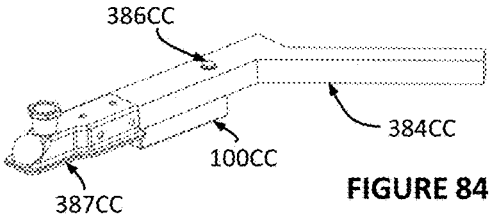
FIG. 84 depicts a top perspective view of the wood splitter of FIG. 83 in a storage mode.
Figure 85:
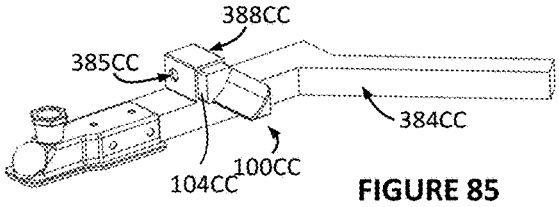
FIG. 85 depicts a top perspective view of a wood splitter secured to a frame of a trailer in an alternative embodiment.

FIGS. 83-90 illustrate another embodiment of a wood splitter 100CC configured for use on a trailer frame 384CC or trailer tongue 383CC instead of a hitch receiver 126. A tongue coupler 387CC is fixed to a trailer tongue 383CC and operable to releasably couple to a hitch ball. In this embodiment (FIG. 83), wood splitter 100CC is secured to trailer frame 384CC using a blade restraint 386CC illustrated here in the form of a pin extending through a body portion 128CC of fixation portion 104CC. The pin is restrained on both a top and bottom end (i.e. bolt head, nut) to retain position. In an operational configuration, wood splitter 100CC is extended outward from trailer frame 384CC to provide access to it as illustrated in FIG. 83. In a storage configuration, wood splitter 100CC is rotated for storage underneath trailer frame 384CC as illustrated in FIG. 84 thereby minimizing contact by those passing by. In an alternative configuration as illustrated in FIG. 85, fixation portion 104CC of wood splitter 100CC is housed within splitter sleeve 388CC having a form reflective of a hitch receiver. In this embodiment, splitter sleeve 388CC is in the form of a section of square tube secured to a top section of trailer frame 384CC. In preferred embodiments, the square tube is welded or bolted to trailer frame 384CC. The internal dimensions of splitter sleeve 388CC are configured for sliding engagement of a fixation portion 104CC of wood splitter 100CC. Splitter sleeve 388CC may include a pin hole 385CC for securing wood splitter 100CC in place in an operational configuration using a hitch pin 112. In a storage configuration, hitch pin is removed and wood splitter 100CC is slid out from splitter sleeve 388CC and preferably stored.

Figure 86:
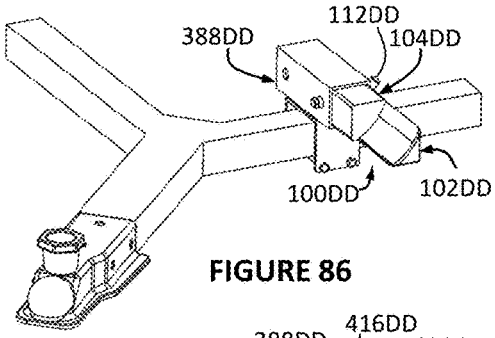
FIG. 86 depicts a top perspective view of a wood splitter with mounting bracket in an operational configuration.
Figure 87:
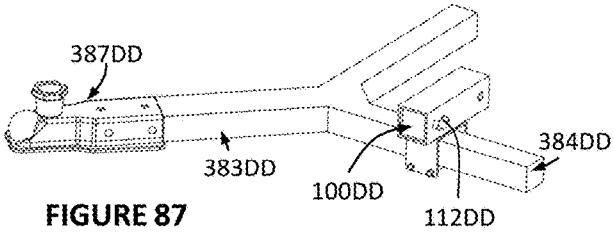
FIG. 87 depicts a top perspective view of the wood splitter of FIG. 86 in a storage configuration.

FIG. 86 represents yet another embodiment of a trailer mounted wood splitter 100DD wherein splitter sleeve 388DD is configured as a bracket for mounting to a trailer frame 384DD having a tongue coupler 387DD. In some embodiments the bracket is permanently fixed such as by welding, and in other embodiments is removable in conjunction with fasteners for example. Squarely configured sleeve walls 416DD define sleeve cavity 414DD which again is sized and shaped for housing wood splitter 100DD therein. In an operational configuration (also known as operational mode), blade portion 102DD is exposed as illustrated in FIG. 86. In a storage configuration (also known as storage mode), wood splitter 100DD is reversed wherein blade portion 102DD is shielded within sleeve cavity 414DD as illustrated in FIG. 87. Hitch pin 112DD may be utilized to secure wood splitter 100DD within splitter sleeve 388DD. One or more bracket fasteners 410DD (i.e. bolt, nut, washers) may be used to secure splitter sleeve 388DD to the trailer, in this case spanning between aligned leg apertures 412DD on first bracket leg 406DD and second bracket leg 408DD. A protectant such as a rubber liner may be used at the internal bracket walls 417DD to minimize abrasion between the bracket and trailer. This removable bracket configuration provides retrofitting to existing trailers and mounting to new trailers without disrupting frame metal or paint.

Figure 89:
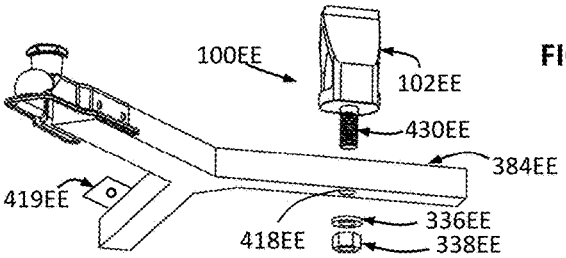
FIG. 89 depicts a bottom perspective exploded view of a wood splitter having a threaded stem.
Figure 90:
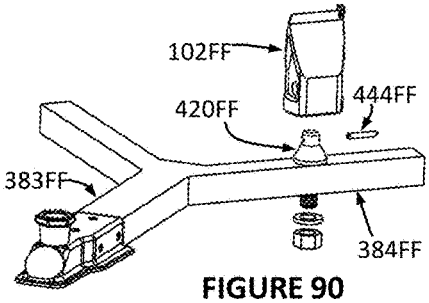
FIG. 90 depicts a top perspective exploded view of a wood splitter configured to mount to an interactive lock head of a base fastener.

FIG. 89 illustrates another embodiment of a wood splitter 100AY whereby the wood splitter 100AY has a stem 430AY that is threaded extending from a base surface 344AY. In this embodiment, frame hole 418AY serving to secure stem 430AY therein, extends through a portion of one or more of a trailer frame and a trailer tongue and a trailer bumper. Stem 430AY is seated in frame hole 418AY for operational use. A hitch ball nut 338AY with hitch ball washer 336AY may be utilized to secure wood splitter 100AY to the trailer frame or trailer tongue. However, in an alternative embodiment, it is unnecessary for stem 430AY to be threaded in which case the user simply drops the post through frame hole 418AY for use, and removes wood splitter 100AY as desired by simply lifting wood splitter 100AY off the trailer frame. In an alternate embodiment, stem 430AY may be secured within the hole of a holed plate 419AY extending fixed or removably fixed from a trailer frame or trailer tongue or from a bracket on either.

Figure 91:
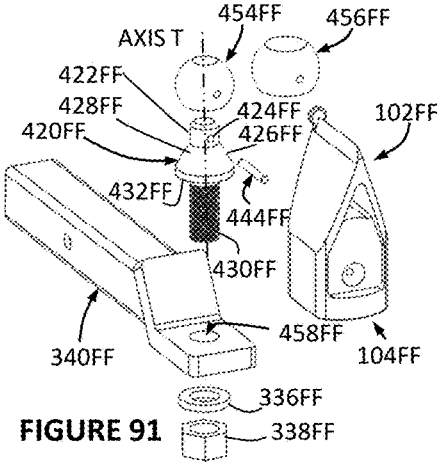
FIG. 91 depicts a top perspective exploded view of interchangeable system capable of mounting various size trailer balls and a wood splitter to a base fastener.
Figure 92:
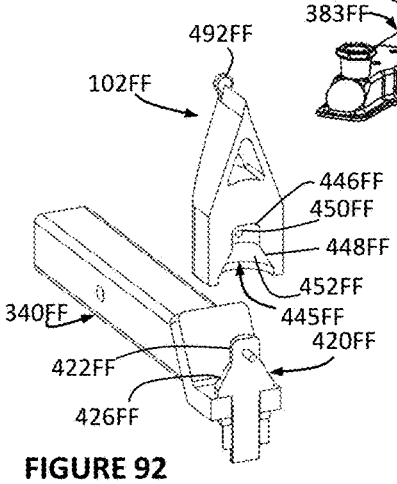
FIG. 92 depicts a perspective cross sectional view through a wood splitter and base fastener of the interchangeable system of FIG. 91.
Figure 93:
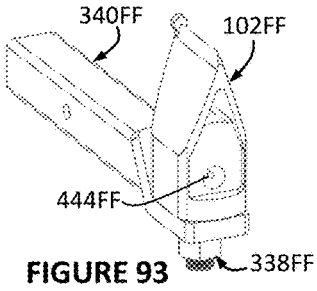
FIG. 93 is a perspective view of the wood splitter of FIG. 92.

FIGS. 90-93 represents various forms of a wood splitting system that includes a base fastener 420FF having an interactive lock head for quick attachment and detachment of parts to it. As illustrated in FIG. 91, (wherein base fastener 420FF is seated in ball mount hole 458FF) base fastener 420FF comprises a central axis T with a broad beveled boss 426FF sloping towards a superiorly protruding center boss 422FF. Head aperture 424FF extends generally perpendicular through center boss 422FF for housing of release pin 444FF. On center boss 422FF and beveled boss 426FF is male surface 428FF. The underside of center boss 422FF is generally flat with base face 432FF thereon. Stem 430FF extends generally centrally and inferiorly from base face 432FF and may be threaded for fixing to a support structure such as a ball mount (FIG. 91), trailer frame (FIG. 90) or trailer tongue, or indirectly through a complementary bracket attached to these structures or holed plate 419EE. Various sized interchangeable trailer balls such as the 1.875" ball 454FF and 2" ball 456FF and 2.3125" ball (not shown) are currently available as interchangeable kits for use with a variety of trailers. Inclusion of an interchangeable wood splitter 100FF offers an expansion creating a novel interchangeable kit that includes wood splitting capabilities when using base fastener 420FF and a complementary support structure such as those mentioned above (i.e. ball mount, trailer frame, holed plate). Alternatively, wood splitter 100FF may be offered as an accessory to swappable hitch kits. In these embodiments, wood splitter fixation portion 104FF comprises a female cavity 445FF generally complementing the size and shape of base fastener 420FF. In this embodiment, female cavity 445FF comprises a female bevel 448FF leading to a superiorly placed female recess 446FF with female surface 452FF thereon both 448FF and 446FF. Pin aperture 450FF extends generally perpendicular to axis 'T' through the body of wood splitter fixation portion 104FF. Distracting release pin 444FF provides the user quick removal of an interchangeable head or blade. To attach wood splitter 100FF, female cavity 445F is aligned along axis 'T' above center boss 422FF and lowered such that center boss 422FF is fully seated within female recess 446FF. Head aperture 424FF is aligned with pin aperture 450FF. Release pin 444FF can then be inserted in the pin aperture spanning across both apertures thereby locking wood splitter 100FF thereon. It is recognized that wood splitter 100FF may be used for splitting without release pin 444FF. Other quick release mechanisms known in the art such as bayonet may be substituted for the previously described pin method.

Figure 94:
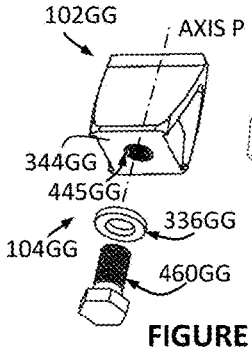
FIG. 94 is a perspective view of a wood splitter having a female cavity and blade lock bolt.
Figure 95:
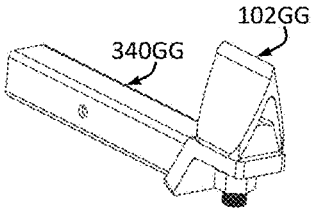
FIG. 95 is a perspective view of a wood splitter having an extended stem and mounted to a ball mount.
Figure 96:
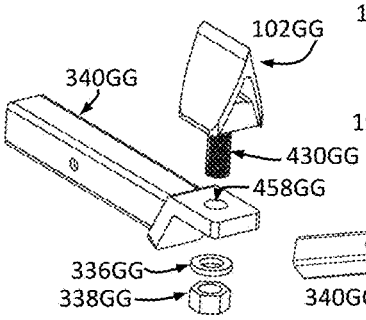
FIG. 96 is an exploded view of the wood splitter and ball mount illustrated in FIG. 95.
Figure 97:
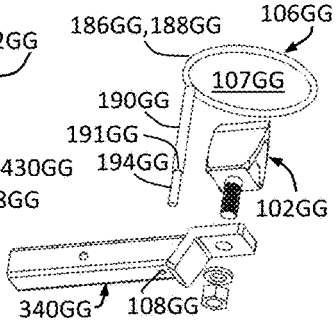
FIG. 97 is an exploded view of the wood splitter and ball mount illustrated in FIG. 95 with a ring shaped guide portion.

FIG. 94-104 illustrate a variety of embodiments of wood splitters configured for mounting to a structure such as a ball mount, trailer frame, bumper, or intermediate bracket attached to these structures. FIG. 94 illustrates a wood splitter 100GG having a female cavity 445GG that is threaded through base surface 344GG along an Axis P. Female cavity 445GG is sized to accept blade lock bolt 460GG securely holding the fixation portion to a ball mount 340GG. Illustrated in FIGS. 95-96 is a similar wood splitter 100GG yet with a stem 430GG which in this case is threaded for capture by hitch ball nut 338GG with hitch ball washer 336GG for securing to a ball mount 340GG through a ball mount hole 458GG. In alternative embodiments, stem 430GG may be utilized without hitch ball nut 338GG and therefore may not require threads in which case wood splitter 100GG utilizes gravity to remain seated during splitting. FIG. 97 illustrates the system shown in FIG. 96 with a guide portion 106GG. Guide portion 106GG comprises a guide wall 186GG with guide surface 188GG formed thereon with the guide wall here in the general shape of a ring which may be fully or only partially enclosed. Guide wall 186GG defines a guide aperture 107GG through which logs may be placed for splitting. Guide wall 186GG is supported by first guide leg 190GG and in some case a second guide leg as illustrated in earlier embodiments. In this embodiment, first guide leg 190GG comprises a first guide foot 194GG portion. A leg stop 191GG is provided to control the vertical position of the guide portion by abutting against an anchor surface such as a surface of a ball mount 340GG as the leg stop is housed in first guide receiver 108GG. In some embodiments, first guide foot 194GG and first guide receiver 108GG have non-circular profiles to keep guide portion 106GG in a predetermined position over blade portion 102GG.

Figure 98:
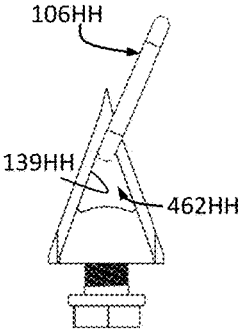
FIG. 98 is a side view of a wood splitter with a novel guide portion.
Figure 99:
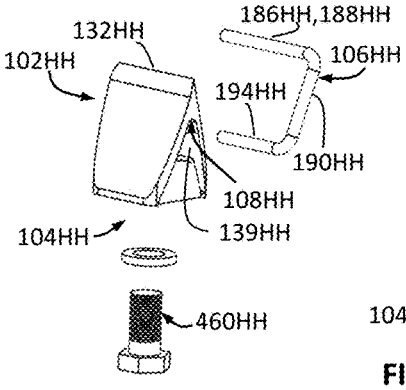
FIG. 99 is an exploded perspective view of the wood splitter of FIG. 98.

FIGS. 98-99 illustrates an embodiment of a wood splitter 100HH having a guide portion 106HH extending from a first guide receiver 108HH in the wood splitter. The guide portion 106HH is generally U-shaped. First guide receiver 108HH may assume a variety of forms such as a hole, groove, or a recess. In this embodiment, wood splitter 100HH comprises an upper window 462HH extending laterally or otherwise diametrically through sides of the wood splitter. Here first guide receiver 108HH is located at a superior junction between two sub-primary deflector faces 139HH that at least partially define upper window 462HH. Welds may be utilized to secure a first guide foot 194HH to at least one of sub-primary deflector faces 139HH. In this embodiment, guide portion 106HH comprises first guide leg 190HH extending between first guide foot 194HH and first guide wall 186HH wherein first guide leg 190HH elevates first guide wall 186HH above cut edge 132HH. As illustrated previously in FIG. 48C, first guide wall is positioned generally parallel and laterally spaced from cut edge 132HH for producing a predetermined thickness of kindling from a log. In addition, first guide wall 186HH may also serve as a user guard to protect from direct exposure to blade portion 102HH. It is recognized that first guide foot 194HH may be secured at a variety of positions within upper window 462HH and at a variety of angles. In an alternative embodiment, guide portion 106HH may be generally L shaped with first guide foot 194HH secured (welds, fasteners, captured) to an external wood splitter 100HH surface, a surface of a receiver block (i.e. 568ZZ FIG. 146), or within a first guide receiver within the receiver block.

Figure 102:
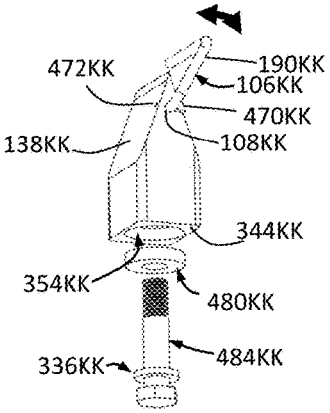
FIG. 102 is an exploded perspective view of another dual mode blade portionwood splitter.
Figure 103:
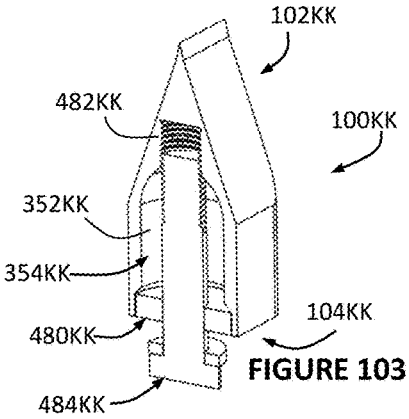
FIG. 103 is a cross sectional view of the dual mode wood splitter of FIG. 102.
Figure 104:
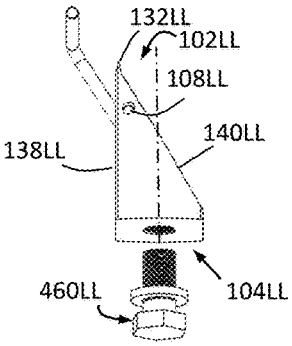
FIG. 104 is a perspective view of a wood splitter having an offset cut edge.

In alternative embodiments such as illustrated in FIGS. 102 and 104, the first guide foot is configured for seating within a first guide receiver 108KK, 108LL in the form of a bore extending through at least a portion of a wood splitter. Again, the first guide wall position may be fixed by welding. Alternatively, as illustrated in FIG. 102, guide portion 106K may be pivotable within first guide receiver 108KK wherein a portion of first guide leg 190KK abuts against guide boss 470KK extending from blade portion 102KK in an operational mode and wherein the guide portion 106KK is folded down against primary deflector face 138KK in a storage mode. Alternatively, a set screw or locking pin may be extended through lock port 472KK to interfere with or otherwise clamp guide portion 106KK in a predetermined position. FIG. 104 represents another example of a wood splitter 100LL having a cut edge 132LL that is offset from a central plane of the wood splitter. In addition, primary deflector face 138LL comprises a steeper angulation than secondary deflector face 14OLL. The steeper angulation arrangement is preferred for steering kindling pieces into a collector.

Figure 100:
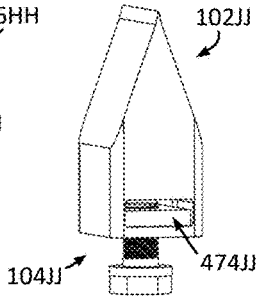
FIG. 100 is a perspective view of a dual mode wood splitter in a posted configuration.
Figure 101:
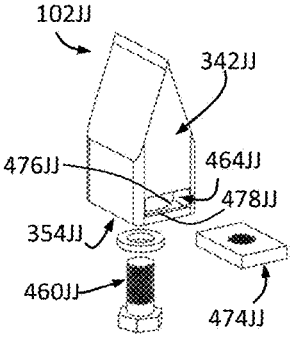
FIG. 101 is an exploded view of the dual mode wood splitter of FIG. 100.

FIGS. 100-103 illustrates a novel wood splitter 100KK capable of securing to an anchor such as a ball mount tongue by fastener or post in a posted configuration, and alternatively by positioning over a hitch ball in a captured ball configuration. For example, in a posted configuration, FIGS. 100 and 101 illustrates a wood splitter 100JJ having a lower window 464JJ extending through at least one side of blade housing 342JJ forming an inset blade floor 476JJ bounded by a floor stop 478JJ illustrated here in the form of a ridge. In this embodiment, a blade nut 474JJ having a centralized threaded hole is slid into lower window 464JJ and seated against blade floor 476JJ and guided by one or more floor stops 478JJ illustrated here in the form of a ridge. Inset blade floor 476JJ is sized to receive blade nut 474JJ. A threaded blade lock bolt 460JJ engages the threaded hole in blade nut 474JJ securing the assembly to an anchor such as within a ball mount hole of a ball mount. In a captured ball configuration, blade nut 474JJ is removed/absent along with blade lock bolt 460JJ to expose ball space 354JJ. Ball space 354JJ has a diameter sufficient for sliding over a hitch ball thereby utilizing the hitch ball to stabilize wood splitter 100JJ during splitting operations. Removal of captured ball style blade portionwood splitters involves the user simply lifting the wood splitter up and off the trailer ball and ball mount (note FIG. 73). FIG. 102 illustrates a second example of a wood splitter 100KK offering both a posted configuration and a captured ball configuration. In a posted configuration, extending into the superior end of ball space 354KK is superior lock recess 482KK having threads complementing extended blade lock bolt 484KK. Extended blade lock bolt 484KK extends through ball space 354KK to engage superior lock recess 482KK to lock wood splitter 100KK to an anchor such as a ball mount or trailer frame. Optional floor plate 480KK comprises a periphery of sufficient size for fit within ball space 354KK and may be positioned in the inferior portion of ball space 354KK to assist positional support of wood splitter 100KK. In a captured ball configuration, extended blade lock bolt 484KK is removed/absent along with floor plate 480KK. Wood splitter 100KK is then set over a ball mount secured hitch ball wherein the hitch ball is captured within ball space 354KK and base surface 344KK rests upon a ball mount surface similar to the embodiment illustrated in FIG. 71. The captured ball configuration is well suited for quick and portable wood splitting due to the simplicity of simply placing the device over a hitch ball of a vehicle.

Figure 105:
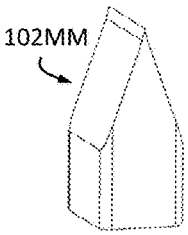
FIG. 105 is a perspective view of a wood splitter configured for a captured ball configuration.
Figure 106:
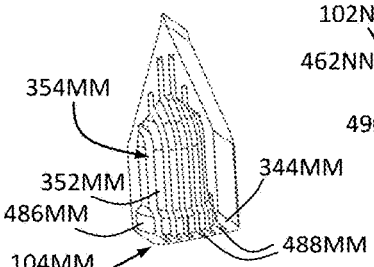
FIG. 106 is a cross sectional view of the wood splitter of FIG. 105 configured for a captured ball configuration with optional flutes.
Figure 107:
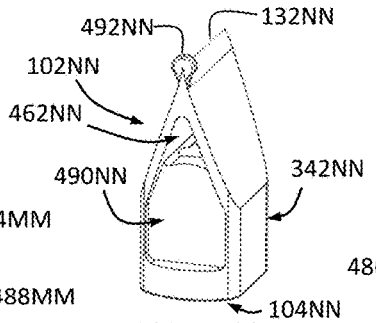
FIG. 107 is a perspective view of a wood splitter configured for a captured ball configuration.
Figure 108:
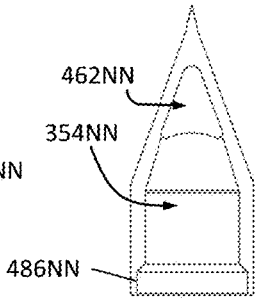
FIG. 108 is a cross sectional view of the wood splitter of FIG. 107 illustrating the internal ball space.

FIGS. 105-111 illustrate additional forms of wood splitters well suited for a captured ball configuration many of which may be formed by machining or metal casting. These embodiments like all others may include a secondary blade (i.e. FIG. 4). FIGS. 105 and 106 illustrates a wood splitter having a capture face 352MM defining an internal ball space 354MM that is sized and shaped for sliding over and capturing a hitch ball therein. Although the ball space may assume many forms, the ball space 354MM is preferably cylindrical and preferably hemi-spherical at a superior end. At an inferior end, the ball space may broaden in diameter at 486MM to accommodate the flared base often seen with a hitch ball. In some embodiments the ball space may not broaden inferiorly. In this event and depending on the hitch ball style, base surface 344MM will be supported by the ball mount base pod (see 345Y, FIG. 73) or the top surface of the flared base of the hitch ball. One or more flutes 488MM may extend through base surface 344MM and capture face 352MM as a means to reduce weight and material. FIG. 107-108 illustrates yet another embodiment of a wood splitter 100NN again comprising an upper window 462NN that intersects with the superior end of ball space 354NN. At one or more ends of cut edge 132NN, a log boss 492NN may be positioned for quick positioning of a log. The log boss is an enlarged mass extending above the cut edge that a user may use to quickly position a log for splitting while also reducing exposure to the blade. In some embodiments, a log boss is positioned on each end of cut edge 132NN. One or more lateral insets 490NN may be used in the blade housing 342NN to reduce weight and material.

Figure 109:
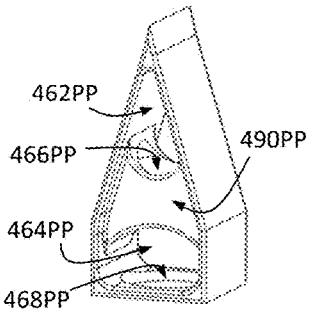
Figure 110:
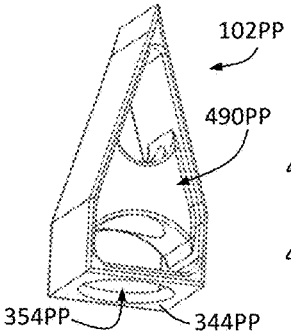
Figure 111:
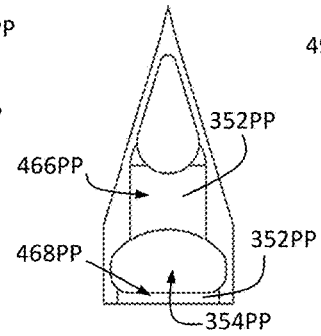

FIG. 109-111 illustrates yet another example of a wood splitter for a captured ball configuration configured to minimize material. In this embodiment, wood splitter 100PP comprises an upper window 462PP, and a lower window 464PP extending through blade housing 342PP. Defined internally in ball space 354PP between upper window 462PP and lower window 464PP is upper chamber 466PP which is preferably positioned such that capture face 352PP is generally aligned with the widest spherical diameter of a hitch ball that would reside therein thereby offering undiminished support. Defined between lower window 464PP and base surface 344PP is lower chamber 468PP preferably sized to capturing a hitch ball base 570AA therein. In some embodiments the lower chamber diameter is sized the same as the upper chamber diameter. In other embodiments, the lower chamber 468PP diameter is larger than the upper chamber 466PP diameter to accommodate hitch balls that have a hitch ball base 570AA of a larger diameter than the hitch ball.

Figure 112:
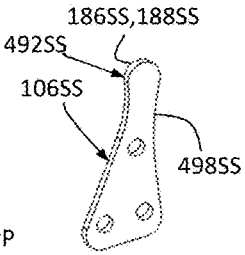
Figure 113:
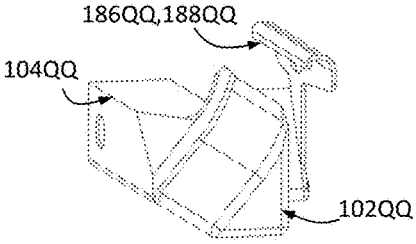
Figure 114:
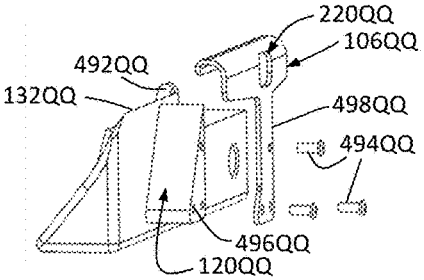
Figure 115:
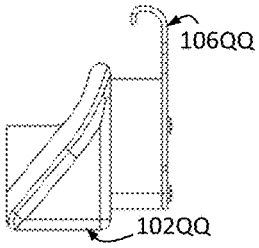
Figure 116:
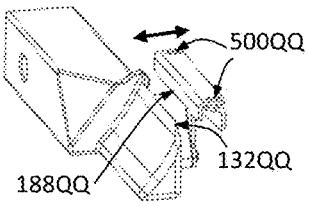

FIGS. 112 through 123 illustrate a select number of embodiments of guide portions. FIGS. 113-115 illustrate a guide portion 106QQ in the form of a plate. In preferred embodiment, guide portion 106QQ is manufactured from sheet metal although other materials such as polymers may be substituted. Extending out from the plate from plate leg 498QQ towards cut edge 132QQ is guide wall 186QQ with guide surface 188QQ thereon. Guide surface 188QQ is generally parallel, superior, and horizontally distanced from cut edge 132QQ a distance for a preferred kindling thickness (i.e. 0.75-1" for example). In this embodiment, a lower portion of plate leg 498QQ is fastened to secondary blade 120QQ by use of one or more guide fasteners 494QQ threading into complementing fastener receivers 496QQ in secondary blade 120QQ. In an alternative embodiment, a sliding glide wall plate is adapted to provide a user the ability to adjust the horizontal distance between the guide surface 188QQ and cut edge 132QQ. Adjustment fasteners at 500QQ may be tightened to secure the sliding guide wall at a predetermined distance based on user preference. In the embodiment of FIG. 112, guide portion 106SS is in the form of a plate with extended superior lobe serving as a guide wall 186SS with guide surface 188SS thereon. Guide portion 106QQ (FIG. 114) may be substituted with guide portion 106SS thereby fastened to secondary blade 120QQ using the same guide fasteners. Log boss 492SS extends above the cut edge on secondary blade 120QQ thereby serving as both a kindling width guide and as a small protectant against blade exposure.

Figure 117:
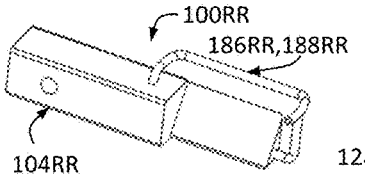
Figure 118:
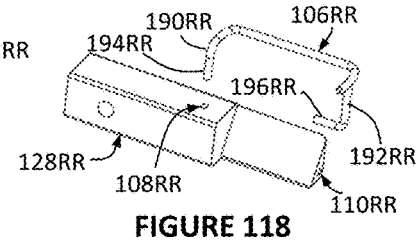
Figure 119:
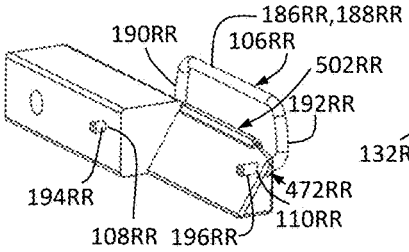

FIG. 117-120 illustrate various configurations of guide portions 106RR of a wood splitter 100RR each having a first guide leg 19ORR with a first guide foot 194RR received in a first guide receiver 108RR in the form of a bore and a second guide leg 192RR with a second guide foot 196RR received in a second guide receiver 11ORR also in the form of a bore. Guide wall 186RR with guide surface 188RR formed thereon spans between first guide leg 19ORR and second guide leg 192RR. In the embodiment of FIGS. 117 and 118, the first and second guide feet are seated into the respective first guide receiver 108RR and second guide receiver 110RR by elastically stretching the two legs apart and aligning them with each hole. Releasing the second guide leg 192RR causes consequent springing of second guide leg 192RR toward second guide receiver 110RR thereby holding the guide portion to the remaining portions of wood splitter 100RR. In this embodiment, first guide receiver 108RR is placed vertical through a fixation portion 104RR whereas second guide receiver 110RR is placed horizontal through a blade portion 102RR. Guide portion 106RR illustrated in FIG. 119 and FIG. 120 also provides adjustability whereby guide surface 188RR may be adjustably locked at various distances from cut edge 132RR. Here first guide foot 194RR and second guide foot 196RR are generally parallel and aligned with a pair of complementary first guide receiver 108RR and second guide receiver 110RR positioned generally perpendicular to cut edge 132RR. A set screw or locking pin may be extended through lock port 472RR to interfere with and lock guide portion 106RR in a predetermined position.

Figure 120:
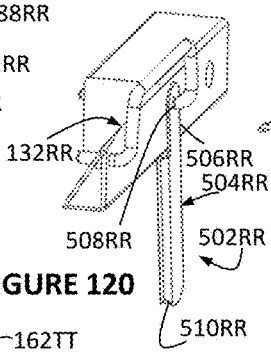

FIGS. 119-122 illustrate various embodiments of optional blade covers 502RR for quickly covering and uncovering a cut edge 132RR of a blade portion 102RR. Blade cover 502RR comprises a cover body 504RR from which one or more cover legs 506RR extends. A spin aperture 508RR extends through at least one cover leg 506RR for occupation by a spin fastener 512RR such as a screw. A blade cap 51ORR may be formed as a U-shaped tunnel (FIG. 120) for seating cut edge 132RR therein or may be in the form of a broad surface (FIG. 122). In the embodiment of FIG. 120, blade cover 502RR is lifted off cut edge 132RR and allowed to spin and hang from the corresponding first or second guide foot 194RR, 196RR. To reapply, the blade cover 502RR is lifted and moved wherein the cut edge rests in the U-shaped tunnel. In the embodiment of FIG. 122, blade cover 502RR spins about spin fastener 512RR. In a covered position, the blade cover is flipped down as illustrated in FIG. 121. In an uncovered position, the blade cover is flipped up to expose the cut edge 132RR during log splitting operations.

FIG. 123-124 represent yet another embodiment of a wood splitter 100TT in accordance with the disclosed invention. In this embodiment, a fixation portion 104TT is in the form of a generally square tube much like the FIG. 7 embodiment. A fixation bore 116TT is located near a distal end of fixation portion 104TT for housing a hitch pin 112 when inserted in a hitch receiver. A first guide receiver 108TT in the form of a bore is located near a proximal end of the fixation portion and extends generally horizontally through it. In this embodiment, a third guide receiver 520TT extends through blade extension 162TT of blade portion 102TT and is located within fixation recess 164TT. Blade portion 102TT may include blade notch 123TT to reduce the diameter of a portion of blade portion 102TT sufficiently to fit within fixation recess 164TT. Blade portion 102TT may be manufactured from sheet metal having an upward facing superior cut edge 132TT and inferiorly placed primary deflector face 138TT for creation of wedging during splitting operations. First guide receiver 108TT may be enlarged (as illustrated FIG. 124) for welding second side extension wall 168TT of blade portion 102TT to the second side recess wall 176TT in fixation recess 164TT. Alternatively, those skilled in the art will recognize that the blade portion 102TT may be fastened using bolts or screws to fixation portion 104TT. Lock collar 514TT is welded to fixation portion 104TT in alignment with first guide receiver 108TT such that first guide foot 194RR passes through a central aperture of lock collar 514TT. User adjustment of lock collar set screw 516TT binds and releases first guide foot 194RR allowing consequent adjustment width between cut edge 132TT and guide surface 188TT for variance of kindling thickness. Guide portion 106TT in this embodiment is a replica of guide portion 106RR and thus comprises similar features and orientations. A secondary blade 120TT extending from a primary blade 118TT as described previously may be provided to produce twice the strands of kindling with each log split.

FIG. 125 illustrates yet another embodiment of a wood splitter having a guide portion 106UU with fixed or adjustable guide wall 186UU and guide surface 188UU thereon. A receiver block 568UU extends superiorly from each of opposite ends of cut edge 132UU. One receiver block having a first guide receiver 108UU therein and the other having a second guide receiver 110UU therein. Guide portion 106UU may be generally U-shaped with opposed fixation apertures 522UU at each end of the U of guide legs 190UU and 192UU. In this embodiment, the fixation apertures 522UU are in the form of slots for kindling thickness adjustment, or may be in the form of holes for fixed kindling thickness. Guide fasteners 494UU extend through fixation apertures 522UU and thread into the respective guide receivers to maintain or adjust position.

FIG. 126 illustrates another embodiment of a wood splitter having a guide portion 106VV in the form of a generally straight bar secured at one end in first guide receiver 108VV. First guide receiver 108VV resides in receiver block 568VV which extends superiorly above cut edge 132VV at a distal end of the cut edge. In this embodiment, guide wall 186VV with guide surface 188VV thereon is in the form of a bar welded, screwed into, clamped or otherwise fixed to first guide receiver 108VV. First guide receiver 108VV may include a bore for receiving the guide portion therein.

FIG. 127 illustrates a variation of a wood splitter having a guide portion 106VV in the form of a generally straight bar secured at one portion in first guide receiver 108VV. First guide receiver 108VV resides superiorly on receiver block 568VV which extends superiorly above cut edge 132VV from a lateral portion of secondary blade 120VV. In this embodiment, guide wall 186VV with guide surface 188VV thereon is in the form of a bar welded, screwed into, clamped or otherwise fixed to first guide receiver 108VV. First guide receiver 108VV may include a hole or channel for receiving the guide portion therein.

FIGS. 128-136 illustrate various forms of wood splitters having a guide portion 106WW switchable between an operational mode (providing guidance through a guide surface to blade cut edge), storage mode (limiting blade exposure by partially shielding cut edge) and an open mode (no guidance with open exposure to blade) in accordance with the disclosed invention. In an open mode as illustrated in FIG. 128, guide wall 186WW is positioned generally perpendicular to cut edge 132WW at a distal end of blade portion 102WW thereby exposing cut edge 132WW. By moving the guide portion 106WW out of the way, the user may use blade portion 102WW for splitting not only smaller kindling pieces, but also to split larger logs into chunks. In a storage mode, guide portion 106WW is rotated such that guide wall 186WW is above and generally parallel with cut edge 132WW thereby minimizing exposure to the cut edge. Second guide foot 196WW may be seated in second guide receiver 110WW which here is in the form of a depression that the foot can elastically snap into and out of. Guide portion 106WW rotates about first guide leg 190WW which terminates in first guide foot 194WW which is housed within first guide receiver 108WW bore. First guide receiver 108WW bore is housed in receiver block 568WW which extends behind secondary blade 120WW. A third guide receiver may be located at a position intermediate blade portion 102WW and fixation portion 104WW for receiving second guide foot 196WW when in open mode. Also illustrated in FIG. 128 is logo face 524WW also located intermediate the blade portion 102WW and fixation portion 104WW. Logo face 524WW faces at least partially proximally and is a face comprising no other features aside from trademark information related the product.

FIGS. 131, 134, 137, and 145-147 illustrate further embodiments of wood splitters in accordance with the disclosed invention with guide portions set in an operational mode or configuration. FIGS. 132, 135 and 138, illustrate further embodiments of wood splitters in accordance with the disclosed invention with guide portions set in an open mode or configuration.

Illustrated in FIG. 130 is another embodiment of a wood splitter comprising an L-shaped guide portion 106XX having guide wall 186XX illustrated here in the form of a round rod. Here at least a portion of first guide foot 194XX and in some cases first guide leg 190XX is threaded, however in alternative embodiments the threads are absent. First guide foot 194XX is housed in first guide receiver 108XX of receiver block 568XX extending between an upper prop floor 538XX and a lower prop floor 540XX. First guide receiver 108XX is in the form of a bore along generally vertical axis H. A faceted collar 530XX extends at least partially around first guide foot 194XX and is illustrated here in the form of a square nut. Faceted collar 530XX is supported vertically by upper prop floor 538XX. Faceted collar 530XX comprises at least a first facet 532XX and a second facet 534XX which interface with block face 528XX on block wall 526XX. In this embodiment, first facet 532XX and second facet 534XX are distanced at approximately 90 degrees. Thus open and operational modes are dependent on whether first facet 532XX or second facet 534XX abuts block face 528XX. Faceted collar 530XX which may be threaded, is fixed on first guide foot 194XX at a predetermined position to provide a desired vertical GAP between guide surface 188XX and blade edge 132XX. Welds, adhesives, pins, or other fixation methods may be used to secure the facet collar in place. In this embodiment, faceted collar 530XX is fixed such that the first facet 532XX is parallel to an axis defining guide surface 188XX and second facet 534XX is perpendicular to an axis defining guide surface 188XX. To switch between open and operational modes, the user simply lifts the guide portion enough to unblock faceted collar 530XX and rotate 90 degrees then re-lower into a blocked position. An inferior restraint such as a nut, pin, or clip may be used to releasably retain guide portion 106XX.

Guide portion 106XX illustrated in FIGS. 133-136 operate using a similar function. In this embodiment, guide portion 106XX is in a turret form as noted in FIG. 136. Faceted collar 530XX is a generally circular block with a central turret aperture 542XX extending therethrough. A facet recess 544XX on a radial surface is bounded by a first facet 532XX and a second facet 534XX. Guide wall 186XX with guide surface 188XX thereon is tangent and radially extends from the faceted collar 530XX. A bottom surface of the faceted collar is supported by upper prop floor 538XX. Guide fastener 494XX extends through turret aperture 542XX and is received in a threaded portion of first guide receiver 108XX. Block wall 526XX with block face 528XX thereon extends upward from upper prop floor 538XX and is positioned to travel within facet recess 544XX when guide portion 106XX is moved between modes. Contact between each facet and the block face limits movement of guide portion 106XX.

FIGS. 137-147 illustrate additional examples of embodiments of guide portions within wood splitters in accordance with the disclosed invention. FIG. 137 illustrates an example of a wood splitter 100YY that is monolithic between a fixation portion 104YY and a blade portion 102YY as might be achieved by machining from a single block of metal or casting processes. In this embodiment, a bottle opener is integrated into a proximal end of blade portion 102YY comprising a downwardly extended bottle flange 221YY defining a bottle open recess 220YY extending upward. The bottle open recess is sufficiently wide to engage a bottle cap therein to wedge it off a bottle for the convenience of the user.

FIG. 140 illustrates an embodiment including optional cavities. A fixation cavity 550YY extends upward from an inferior portion of a wood splitter 100YY into the fixation portion 104YY. Embodiments may also include a primary blade cavity 546YY also extending upward from an inferior portion of wood splitter 100Y but into the primary blade. Some embodiments include a secondary blade cavity 548ZZ extending upward from lower prop floor 540ZZ at an inferior portion of a wood splitter 100ZZ into a secondary blade 120ZZ as illustrated in FIG. 143. One or more cavity dividers 562ZZ may be present to reinforce the cavities.

First guide receiver 108YY, 108ZZ (within receiver block 568YY, 568ZZ) in these embodiments is in the form of a generally vertical bore. Receiver block 568YY, 568ZZ are located intermediately between a fixation portion 104YY, 104ZZ and a blade portion 102YY, 102ZZ. First guide receiver 108YY, 108ZZ is configured to house a first guide foot 194YY, 194ZZ therein. Formed in an upper prop floor 538YY, 538ZZ is block wall 526YY, 526ZZ which is in the form of a channel for cradling various parts of guide portion 106YY, 106ZZ. Offset approximately 90 degrees from the block wall is secondary block wall 527YY, 527ZZ with secondary block face 529YY, 529ZZ thereon which is also in the form of a channel for cradling various parts of guide portion 106YY, 106ZZ as illustrated in the Figures. As illustrated in FIG. 139, the channels formed by the block wall and the secondary block wall intersect at generally 90 degrees in this embodiment but may vary in other embodiments.

Illustrated in FIG. 141 is an alternative embodiment of a guide portion 106YY having a generally circular guide wall 186YY with guide surface 188YY formed thereon. A generally vertical first guide leg 190YY extends substantially perpendicular from generally horizontal guide wall 186YY terminating in a first guide foot 194YY. A prong 558YY, here L-shaped, extends between the first guide leg 190YY and another portion of guide wall 186YY at a distance. First guide foot 194YY is sized to be received and secured in first guide receiver 108YY. Prong 558YY is positioned to reside in the channel formed by secondary block wall 527YY thereby maintaining the height of the guide wall 186YY and its position generally centered over cut edge 132YY. Guide portion 106YY may be formed from a variety of manufacturing techniques including casting and welding of formed rods. As illustrated in previous figures such as FIG. 10A, guide wall 186YY may not be fully enclosed. In alternative embodiments, a second guide leg 192YY may be extended for extra support as illustrated and received in a second guide receiver 110WW such as shown in FIG. 128. The guide illustrated may be inserted or removed by aligning the guide feet to the respective guide receivers and applying an upward or downward force.

FIGS. 144-147 illustrate yet another guide portion 106ZZ also formed in an L shape. In this embodiment, a prong 558ZZ extends from a side of first guide leg 190ZZ. Prong 558ZZ in this embodiment is generally cylindrical and positioned generally perpendicular first guide leg 190ZZ while also being generally parallel with guide wall 186ZZ although distanced inferiorly from it. Welds or fasteners may be used to fix prong 558ZZ to first guide leg 190ZZ. An optional inferior restraint 536ZZ may be utilized at first guide foot 194ZZ to prevent unintended release of the guide portion from first guide receiver 108ZZ.

FIG. 144 also illustrates an alternative form of construction of a wood splitter 100ZZ. In this embodiment, a tubular fixation portion 104ZZ is fixed to a casted or machined blade portion 102ZZ. Tubular fixation portion 104ZZ may be cut from a length of tubular metal stock. Alternatively bar stock may be used. In preferred forms, the fixation portion has a square profile with a nominal dimension of 2 inch×2 inch or 1.25 inch×1.25 inch for sliding fit into standard hitch receivers. Intermediate cavity 552ZZ is optional, however when present may be sized for the tube or bar stock of fixation portion 104ZZ to slide in and reside partially inside the intermediate cavity 552ZZ. Alternatively, intermediate cavity 552ZZ may be sized small enough such that an end of fixation portion 104ZZ will not fit within intermediate cavity 552ZZ and sits flush with terminal face 554ZZ. One or more positioning pods 556ZZ extending from terminal face 554ZZ may be used to rapidly align blade portion 102ZZ and fixation portion 104ZZ during manufacturing.

Due to variability of wood grains encountered during splitting, kindling pieces may become wedged between secondary blade 120ZZ and receiver block 568ZZ which define wood chute 566ZZ. To minimize wedging, combinations of the following features may be implemented. First, step back 560ZZ is utilized to further distance receiver block 568ZZ from log boss 492ZZ. Secondly, wood chute 566ZZ is wider inferiorly by beveling back the face of receiver block 568ZZ. Third, secondary blade 120ZZ is generally vertical or negatively sloped on the side facing wood chute 566ZZ. In preferred embodiments, wood chute 566ZZ also widens with increasing lateral distance from cut edge 132ZZ. In alternative embodiments, secondary blade 120ZZ is absent.

FIG. 147 illustrates a wood splitter variation having a solid fixation portion which may be in the form of a bar welded to the blade portion or casted as a monolithic part. In this Figure, the bar has a nominal diameter of 1.25"× 1.25". Other embodiments are nominally 2"×2". Custom diameters may be utilized.

FIG. 148 illustrates an alternative embodiment of a wood splitter with optional guide portion removed. Note that the body of blade portion 102II as illustrated is curved as is cut edge 132II. In some embodiments this curvature is concave whereas in others the curvature is convex.

FIG. 151 illustrates a familiar form of a jack stand having a jack stand base 700AB and a jack stand lift arm 702AB captured within base cavity 701AB of jack stand base 700AB along axis W. A variety of locking mechanisms are utilized in the prior art for locking the overall height of jack stands including but not limited to pinned aligned bores, and toothed jack stand lift arms. The locking mechanisms are immaterial to the wood splitting functions described. The embodiment illustrated in the Figures uses pinned aligned bores as noted by first jack pin receiver 707AB which extends through base cavity 701AB of jack stand base 700AB. First jack pin receiver 707AB is aligned with one of the second jack pin receivers 709AB on the jack stand lift arm for a predetermined height then pinned for locking with jack pin 706AB. As illustrated in FIG. 153, a novel cover blade 708AB comprises a blade housing 342AB having a cover blade cavity 710AB extending in from an inferior surface. Cover blade cavity 710AB is sized and shaped to house lift pod 711AB therein. This creates a novel form of jack stand wood splitter 715AB. Cover blade cavity 710AB is defined by capture faces 352AB and terminates in base surface 344AB superiorly. Cut edge 132AB is positioned at a superior end with an opposed primary deflector face 138AB and secondary deflector face 140AB angled with respect to each other to create a wedge.

In an alternative embodiment, a jack stand lift arm of a jack stand is substituted with a jack stand blade arm as illustrated in FIG. 154-155 to form a novel jack stand wood splitter. In this embodiment, jack stand blade arm 704AB replicates jack stand lift arm 702AB except lift pod 711AB is replaced with blade portion 102AB. Jack stand blade arm 704AB comprises a lift trunk 713AB extending from blade portion 102AB which is sized and shaped for being received in base cavity 701AB and fixed using jack pin 706AB. Blade portion 102AB comprises an upward facing cut edge 132AB with opposed primary deflector face 138AB and secondary deflector face 140AB forming a splitting wedge. As illustrated elsewhere, one or more of a; log boss (i.e. 492Q), first bumper (i.e. 222V), and guide portion may be used to guide the log splitting and also minimize cut edge exposure.

One example of a method of use of a jack stand wood splitter using a cover blade comprises the following steps. The user obtains a jack stand assembly 716AB and places it on a ground surface. The user then obtains a cover blade 708AB and aligns cover blade cavity 710AB with the top of lift pod 711AB of jack stand lift arm 702AB and lowers the cover blade 708AB until base surface 344AB rests on the superior end of lift pod 711AB. The user then places one end of a log on top of cut edge 132AB and impacts the other end of the log causing it to split with pieces falling to the ground. In a second method in accordance with the FIG. 155 embodiment, the user again obtains a jack stand assembly 716AB and places it on a ground surface. The user removes jack stand lift arm 702AB and substitutes it with jack stand blade arm 704AB and locks into position with jack pin 706AB. The user then places one end of a log on top of cut edge 132AB of jack stand blade arm 704AB and impacts the other end of the log causing it to split with pieces falling to the ground.

In one embodiment, a method for splitting wood in accordance with the disclosed invention comprises one or more of the following steps as illustrated in FIG. 149. Obtaining a wood splitter (580) having a blade portion and a fixation portion extending from the blade portion and wherein the blade portion comprises an upward facing cut edge situated between a primary deflector face and a secondary deflector face and wherein at least a portion the fixation portion is sized and shaped to be received in a hitch receiver of a vehicle. Then obtaining a vehicle having a hitch receiver (582). Aligning the fixation portion of the wood splitter with the receiver cavity of the vehicle's hitch receiver (584). Sliding at least a portion of the fixation portion of the wood splitter into the receiver cavity whereby the wood splitter is supported entirely by the hitch receiver (586). Optionally aligning a fixation bore on the fixation portion with a pin hole of the hitch receiver (588). Optionally securing the wood splitter with a hitch pin (590). Optionally placing a collector under the wood splitter (and angling if so desired) to collect wood pieces (592). Removing and/or repositioning blade covers if present and couple guide portion and/or reset guide mode as desired (594). Reattaching removable edge portion and other blade portions if so equipped (596). Grasping a log to be split preferably from its side by hand or grasping tool (598). Positioning a log in any one of the following positions with respect to the wood splitter: against a guide surface of a guide portion (600), within a guide aperture (602), over blade with guide absent (604), over blade with guide in open mode (606). Positioning the end of the log to be split on the upward facing cut edge of a primary blade of the blade portion (610) and simultaneously optionally positioning the log against a log boss if present (608) and optionally positioning log over both primary and secondary blade if present (612). Grasping an impactor such as a hammer or mallet (614). Impacting the opposing end of the log with sufficient force to cause it to split and wood pieces to fall to ground or into a collector if present (616). Repeating the process to split the next log (618).

In one embodiment (FIG. 150), a method for splitting wood in accordance with the disclosed invention comprises one or more of the following steps. Obtaining a vehicle having a hitch receiver (630). Obtaining a ball mount with a hitch ball secured thereon (632). Aligning the ball mount with the receiver cavity of the vehicle's hitch receiver (634). Sliding at least a portion of the ball mount into the receiver cavity (636). Optionally aligning a fixation bore on the ball mount with a pin hole of the hitch receiver (638). Optionally securing the ball mount with a hitch pin (640). Optionally placing a collector under the wood splitter (and angling if so desired) to collect wood pieces (642). Obtaining a wood splitter with blade portion having an internal ball space in a fixation portion and placing it over the hitch ball such that the hitch ball occupies the ball space (644). Removing and/or repositioning blade covers if present and couple guide portion and/or reset guide mode as desired (646). Reattaching removable edge portion and other blade portions if so equipped (648). Grasping a log to be split preferably from its side by hand or grasping tool (650). Positioning a log in any one of the following positions with respect to the wood splitter: against a guide surface of a guide portion (652), within a guide aperture (654), over blade with guide absent (656), over blade with guide in open mode (658). Positioning the end of the log to be split on the upward facing cut edge of a primary blade of the blade portion (662) and simultaneously optionally positioning the log against a log boss if present (660) and optionally positioning log over both primary and secondary blade if present (664). Grasping an impactor such as a hammer or mallet (668). Impacting the opposing end of the log with sufficient force to cause it to split and wood pieces to fall to ground or into a collector if present (670). Repeating the process to split the next log (672). When finished, the user lifts the blade portion and wood splitter off the hitch ball making the hitch ball available for use in towing.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A method for splitting wood comprising the steps of:

obtaining a wood splitter having a blade portion and a fixation portion extending from the blade portion and wherein the blade portion comprises an upward facing cut edge situated between a primary deflector face and a secondary deflector face and wherein at least a portion of said fixation portion is sized and shaped to be received in a hitch receiver of a vehicle;

obtaining a vehicle having a hitch receiver with a receiver cavity operable to receive at least a portion of the fixation portion in the receiver cavity;

aligning the fixation portion of the wood splitter with the receiver cavity of the vehicle's hitch receiver;

sliding at least a portion of the fixation portion of the wood splitter into the receiver cavity whereby the wood splitter is supported entirely by the hitch receiver;

positioning an end of a log to be split on the upward facing cut edge of the blade portion; and impacting the opposing end of the log whereas the upward facing cut edge splits at least a portion of the log while the wood splitter is fully supported by the hitch receiver.

2. The method of claim 1 further comprising a step of placing a collector below and spaced from the wood splitter whereby kindling pieces split from the log fall and are collected in the collector.

3. The method of claim 1 further comprising a step of aligning a fixation bore in the fixation portion with a pin hole of the hitch receiver and securing the wood splitter by inserting a hitch pin therein.

4. The method of claim 1 wherein the step of positioning an end of a log to be split on the upward facing edge of the blade portion further comprises a step of positioning the log within a guide aperture positioned above the upward facing cut edge.

5. The method of claim 1 wherein the step of positioning an end of a log to be split on the upward facing cut edge of the blade portion further comprises a step of positioning the log against a guide surface of a guide portion.

6. The method of claim 1 wherein the step of positioning an end of a log to be split on the upward facing edge of the blade portion further comprises a step of positioning the log against a log boss whereas the log boss is in the form of an enlarged mass extending above the cut edge.

7. The method of claim 1 wherein the step of impacting the opposing end of the log whereas the upward facing cut edge splits at least a portion of the log while the wood splitter is fully supported by the hitch receiver further comprises a step of utilizing one or more of a hammer and mallet to cause the impact.

8. The method of claim 1 further comprising a step of coupling a guide portion to a body portion of the wood splitter.

9. The method of claim 1 further comprising a step of coupling a removable edge portion comprising the cut edge to the blade portion.

10. The method of claim 1 further comprising a step of removing a blade cover to expose the cut edge of the blade portion before splitting wood.

11. A method for splitting wood comprising the steps of:

obtaining a vehicle having a hitch receiver and seated in the hitch receiver is at least a portion of a ball mount with a hitch ball secured on the ball mount;

obtaining a of a wood splitter having a blade portion and a fixation portion whereas the blade portion comprises an upward facing cut edge situated between a primary deflector face and a secondary deflector face and wheras the fixation portion extends from the blade portion and comprises an internal ball space sized to capture a hitch ball therein;

placing the fixation portion of the wood splitter over the hitch ball such that at least a portion of the hitch ball is housed within the ball space with the blade portion above the hitch ball and facing upwards;

placing an end of a log to be split on the upward facing cut edge of the blade portion; and impacting the opposite end of the log thereby driving the log against the upward facing cut edge consequently splitting of at least a portion of the log.

12. The method of claim 11 further comprising a step of placing a collector below and spaced from the wood splitter whereby kindling pieces split from the log fall into the collector.

13. The method of claim 11 further comprising a step of aligning a fixation bore in the ball mount with a pin hole of the hitch receiver and securing the ball mount by inserting a hitch pin therein.

14. The method of claim 11 wherein the step of placing an end of a log to be split on the upward facing cut edge of the blade portion further comprises a step of positioning the log within a guide aperture positioned above the upward facing cut edge.

15. The method of claim 11 wherein the step of placing an end of a log to be split on the upward facing cut edge of the blade portion further comprises a step of positioning the log against a guide surface of a guide portion.

16. The method of claim 11 wherein the step of placing an end of a log to be split on the upward facing cut edge of the blade portion further comprises a step of positioning the log against a log boss whereas the log boss is in the form of an enlarged mass extending above the cut edge.

17. The method of claim 11 wherein the step of impacting the opposite end of the log against the upward facing cut edge consequently splitting at least a portion of the log further comprises a step of utilizing one or more of a hammer and mallet to cause the impact.

18. The method of claim 11 further comprising a step of coupling a guide portion to a body portion of the wood splitter.

19. The method of claim 11 further comprising a step of coupling a removable edge portion comprising the cut edge to the blade portion.

20. The method of claim 11 further comprising a step of removing a blade cover to expose the cut edge of the blade portion before splitting wood.

* * * * *